US006816833B1

(12) United States Patent
Iwamoto et al.

(10) Patent No.: US 6,816,833 B1
(45) Date of Patent: Nov. 9, 2004

(54) AUDIO SIGNAL PROCESSOR WITH PITCH AND EFFECT CONTROL

(75) Inventors: Kazuhide Iwamoto, Hamamatsu (JP); Shinichi Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/183,641

(22) Filed: Oct. 30, 1998

(30) Foreign Application Priority Data

Oct. 31, 1997 (JP) ..... 9-316492
Oct. 31, 1997 (JP) ..... 9-316493
Oct. 31, 1997 (JP) ..... 9-316494
Oct. 31, 1997 (JP) ..... 9-316495
Oct. 31, 1997 (JP) ..... 9-316496

(51) Int. Cl.[7] ..... G10L 11/04

(52) U.S. Cl. ..... 704/207; 704/206; 704/268; 84/622; 84/659; 381/61

(58) Field of Search ..... 704/207, 270, 704/272, 275, 278, 206, 268; 84/610, 634, 669, 613, 622–633, 637, 659, 650–652; 381/101, 102, 104, 107, 109, 61–63; 434/307 A

(56) References Cited

U.S. PATENT DOCUMENTS 5,231,671 A * 7/1993 Gibson et al. ..... 704/205
5,301,259 A * 4/1994 Gibson et al. ..... 704/258
5,315,662 A * 5/1994 Hayashi et al. ..... 381/107

(List continued on next page.)

FOREIGN PATENT DOCUMENTS

| | | |
|---|---|---|
| EP | 0 729 130 | 8/1996 |
| GB | 2 290 685 | 1/1996 |
| GB | 2 295 754 | 6/1996 |
| JP | 61-101800 | 6/1986 |
| JP | 63-129400 | 6/1988 |
| JP | 63-174096 | 7/1988 |
| JP | 4-42297 | 2/1992 |
| JP | 4-51838 | 8/1992 |
| JP | 4-242290 | 8/1992 |
| JP | 9-68978 | 3/1997 |

OTHER PUBLICATIONS

Office action for Japanese Patent Application No. H–09–316493, Japanese Patent Office, Dated Mar. 5, 2002.
Office action for Japanese Patent Application No. H–09–316492, Japanese Patent Office, Dated Mar. 5, 2002.
Office action for Canadian Patent Application No. 2,249, 731, Canadian Patent Office, Dated Dec. 10, 2001.

*Primary Examiner*—Richemond Dorvil
*Assistant Examiner*—A. Armstrong
(74) *Attorney, Agent, or Firm*—Morrison & Foerster LLP

(57) ABSTRACT

An audio processing apparatus is constructed for generating an auxiliary audio signal based on an original audio signal and mixing the auxiliary audio signal to the original audio signal. In the apparatus, a control section designates a pitch of the auxiliary audio signal. A processing section processes the original audio signal under control of the control section to generate the auxiliary audio signal having the designated pitch, and applies a first effect to the generated auxiliary audio signal. An effector section applies a second effect different from the first effect to the original audio signal. An output section outputs the original audio signal applied with the second effect concurrently with the auxiliary audio signal applied with the first effect. The control section may control the processing section to alter the first effect dependently on a difference between a pitch of the original audio signal and the designated pitch of the auxiliary audio signal.

6 Claims, 15 Drawing Sheets

U.S. PATENT DOCUMENTS 5,410,603 A * 4/1995 Ishiguro et al. ..... 381/61
5,446,238 A * 8/1995 Koyama et al. ..... 84/669
5,686,684 A * 11/1997 Nagata et al. ..... 84/631
5,719,346 A * 2/1998 Yoshida et al. ..... 84/631
5,739,452 A * 4/1998 Nagata ..... 84/610
5,741,992 A 4/1998 Nagata ..... 84/631
5,753,845 A * 5/1998 Nagata et al. ..... 84/626
5,773,744 A * 6/1998 Nagata ..... 84/610
5,811,707 A * 9/1998 Kakehashi et al. ..... 84/610
5,852,800 A * 12/1998 Modeste et al. ..... 704/211
5,857,171 A * 1/1999 Kageyama et al. ..... 704/268
5,902,950 A * 5/1999 Kato et al. ..... 84/610
5,939,654 A * 8/1999 Anada ..... 84/610
6,046,395 A * 4/2000 Gibson et al. ..... 84/603
6,307,140 B1 * 10/2001 Iwamoto ..... 84/622
6,629,067 B1 * 9/2003 Saito et al. ..... 704/207

* cited by examiner

AUDIO SIGNAL PROCESSOR WITH PITCH AND EFFECT CONTROL

BACKGROUND OF THE INVENTION

1. Field of the Invention

The present invention generally relates to an audio signal processing apparatus for adding a harmony signal to an audio signal. The present invention also relates to an audio signal processing apparatus for generating, based on a first audio signal, a second audio signal of which pitch is controlled by the pitch of the first audio signal. Further, the present invention relates to an audio signal processing apparatus for imparting an effect to an audio signal. Still further, the present invention relates to an audio signal processing apparatus for processing two or more audio signals such that two or more sound images are localized at random positions when two or more audio signals are sounded.

2. Description of Related Art

Japanese Published Unexamined Patent Application No. Hei 4-42297 discloses a technology by which the pitch of an input voice signal is detected in real time and a harmony voice signal is mixed to the voice of the singer. Recently, this technology is commercially available in a plug-in board of a tone generator. In this plug-in board, the pitch of an inputted voice signal is shifted to provide a harmony voice signal, which is then mixed with an original voice signal, and a resultant mixed signal is outputted from a loudspeaker. However, because the original voice and the harmony voice have similar voice quality, the harmony voice becomes blurred. In addition, because performance expressions using the pitch-shifted harmony voice are limited in variety, monotonous performances sometimes result.

Japanese Published Examined Patent Application No. Hei 4-51838 discloses an audio signal processing apparatus for detecting the pitch of a singer's voice, forming note data from the detected pitch, sequentially storing the formed note data, and sequentially reading the stored note data for music performance. The disclosed apparatus allows the singer to merely sing to generate corresponding music tones without playing a keyboard. However, the actual pitch of the detected input voice signal is rounded to a discrete pitch that corresponds to note names of music. This causes stepwise change in pitch. Therefore, such an apparatus is suitable for playing keyboard musical instruments in which tones are played by discrete pitches. As for singing, however, a voice pitch is sometimes varied continuously. In this case, a corresponding tone of which pitch is continuously varied must be generated according to the pitch of the continuously changing voice. Modifying the note data by editing may partially impart a continuous variation to the pitch of the stepwise music tone. However, the processing required is time-consuming and burdensome. On the other hand, Japanese Published Unexamined Patent Application No. Hei 4-242290 discloses a method of generating only note information when converting the pitch of an input voice into performance information, or generating both note information and pitch bend information. However, the conventional method is not intended to appropriately switch between the two modes of converting the pitch into performance information as required. The conventional method does not consider the processing to be executed when the voice pitch continuously varies beyond the pitch bend range.

A so-called delay effect is known such that imparting of an effect to a music tone signal is started after passing of a preset delay time from starting the generation of the tone signal. Such a delay effect includes delay vibrato and delay tremolo. For example, the delay effect is imparted as follows to a music tone signal continuously sounded. FIG. 5B illustrates how the delay effect is imparted conventionally. The effect to be imparted in FIG. 5B is delay vibrato for example. Referring to FIG. 5B, to continuously vary a pitch, plural tone signals (1) through (4) are successively and continuously sounded. When the top tone signal (1) enters a note-off state, the next tone signal (2) enters a note-on state. This holds true for the subsequent tone signals (2) through (4). When the delay vibrato is imparted to these continuous tone signals (1) through (4), the imparting of the effect starts after a predetermined time from the note-on event and stops at the end of the music tone signal (1). This holds true for the subsequent continuous tone signals. Consequently, the imparted effect becomes intermittent on the continuous tone signals (1) through (4) in spite of the intention that the delay effect should provide substantially one continuous tone in performance, thereby causing a feeling of disagreeableness.

Random panning has been conventionally practiced as a sort of acoustic effect. In the random panning, a tone signal is localized in a random fashion. For example, in the random panning, a tone signal played by a user is heard as if traveling from random positions, somewhere on the right side and then somewhere on the left side relative to the user. However, an attempt to localize the sound images of two or more tone signals in a random fashion may incidentally results in the localization of different tone signals at the same position. If this happens, the tone signals are clustered at one point, suddenly making the sound field width narrow. Especially, when two or more sound images are localized at the center point, the sound field is made extremely narrow.

SUMMARY OF THE INVENTION

It is therefore a first object of the present invention to provide an audio signal processing apparatus for generating a highly distinct harmony voice over an original voice. This processing apparatus is also intended to impart various effects to the harmony voice.

It is a second object of the present invention to provide an audio signal processing apparatus that, when generating a second audio signal of which pitch is controlled based on the pitch of a first audio signal, allows a user to select between a performance in which the pitch varies stepwise in registration with a pitch name or note of the first audio signal and another performance in which the pitch continuously varies following the pitch of the first audio signal.

It is a third object of the present invention to provide an audio signal processing apparatus that generates an audio signal of which pitch continuously varies following a continuously varying pitch of another audio signal, and that makes smooth the pitch change of the generated audio signal.

It is a fourth object of the present invention to provide an audio signal processing apparatus for continuously imparting a time-varying effect such as a delay effect to two or more continuous audio signals.

It is a fifth object of the present invention to provide an audio signal processing apparatus for imparting a stable random panning effect to two or more harmony audio signals.

In a first aspect of the invention, an audio processing apparatus is constructed for generating an auxiliary audio signal based on an original audio signal and mixing the auxiliary audio signal to the original audio signal. In the inventive apparatus, a control section designates a pitch of the auxiliary audio signal. A processing section processes the original audio signal under control of the control section to generate the auxiliary audio signal having the designated pitch, and applies a first effect to the generated auxiliary audio signal. An effector section applies a second effect different from the first effect to the original audio signal. An output section outputs the original audio signal applied with the second effect concurrently with the auxiliary audio signal applied with the first effect. Preferably, the control section controls the processing section to alter the first effect dependently on a difference between a pitch of the original audio signal and the designated pitch of the auxiliary audio signal.

Further, the inventive audio processing apparatus is constructed for generating an auxiliary audio signal based on an original audio signal. In the inventive apparatus, a detecting section detects an original pitch of the original audio signal. A processing section carries out a pitch conversion of the original audio signal based on the detected original pitch to generate the auxiliary audio signal having a converted pitch, and applies an effect to the generated auxiliary audio signal. A control section controls the processing section to alter the effect applied to the auxiliary audio signal dependently on a difference between the original pitch of the original audio signal and the converted pitch of the auxiliary audio signal.

In a second aspect of the invention, an audio processing apparatus is constructed for generating a synthetic audio signal in response to an original audio signal. In the inventive apparatus, a detecting section sequentially detects a pitch of the original audio signal. A generating section generates the synthetic audio signal having a pitch varying in response to that of the original audio signal. A control section operates in a first mode for quantizing the detected pitch of the original audio signal into a sequence of notes to control the generating section such that the pitch of the synthetic audio signal varies stepwise in matching with the sequence of the notes, and operates in a second mode for controlling the generating section according to the detected pitch of the original audio signal such that the pitch of the synthetic audio signal continuously varies to follow that of the original audio signal. A switch section switches the control section between the first mode and the second mode. Preferably, the switch section can switch the control section while the generating section is generating the synthetic audio signal.

Further, the inventive audio processing apparatus is constructed for generating a synthetic audio signal in response to an original audio signal. In the inventive apparatus, a detecting section detects a pitch of the original audio signal. Another detecting section detects a volume of the original audio signal. A generating section generates the synthetic audio signal. A control section controls the generating section to vary a pitch of the synthetic audio signal according to the detected pitch of the original audio signal. Another control section controls the generating section to vary a volume of the synthetic audio signal according to the detected volume of the original audio signal.

In a third aspect of the invention, an audio processing apparatus is constructed for generating a synthetic audio signal in response to an original audio signal. In the inventive apparatus, a detecting section detects a varying pitch of the original audio signal. A generating section generates the synthetic audio signal. A control section controls the generating section to vary a pitch of the synthetic audio signal according to the detected varying pitch of the original audio signal. The control section determines a first note from the detected varying pitch of the original audio signal for controlling the generating section to generate the first note of the synthetic audio signal while bending a pitch of the synthetic audio signal around the first note in response to a deviation of the detected varying pitch from the first note. Then, the control section determines a second note from the detected varying pitch when the deviation thereof from the first note exceeds a predetermined value for controlling the generating section to stop the first note and to generate the second note of the synthetic audio signal. Preferably, the generating section generates the first note and the second note which has an amplitude envelope substantially the same as that of the first note.

In a fourth aspect of the invention, an audio processing apparatus is constructed for applying an effect to an audio signal. In the inventive apparatus, a generating section is controlled to generate the audio signal for creating either of a continuous sequence of music notes and a discrete sequence of music notes. An effector section is triggered in response to an occurrence of each music note for applying a time-varying effect to each music note of the generated audio signal. A control section operates when the generating section generates the continuous sequence of the music notes including a first music note and subsequent music notes for controlling the effector section to maintain the time-varying effect once applied to the first music note even after the first music note ceases so that the time-varying effect is continuously applied to the subsequent music notes while preventing further time-varying effects from being triggered in response to the subsequent music notes. Preferably, the effector section starts application of the time-varying effect to the music note with a predetermined delay of time after the generating section starts generation of the music note.

In a fifth aspect of the invention, an audio processing apparatus is constructed for locating a plurality of audio signals to a plurality of regions. In the inventive apparatus, an input section provides the plurality of the audio signals concurrently with each other. An output section mixes the plurality of the audio signals with each other while locating the plurality of the audio signals to the plurality of the regions. A control section controls the output section to randomize the locating of the audio signals. The control section comprises a determination sub section that randomly assigns one region to one of the audio signals, a memory sub section that memorizes said one region assigned to said one audio signal, and another determination subsection that randomly assigns another of the regions except for said memorized region to another of the audio signals to thereby avoid duplicate assignment of the same region to different ones of the audio signals while ensuring randomization of the locating of the audio signals.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

Figure 1:
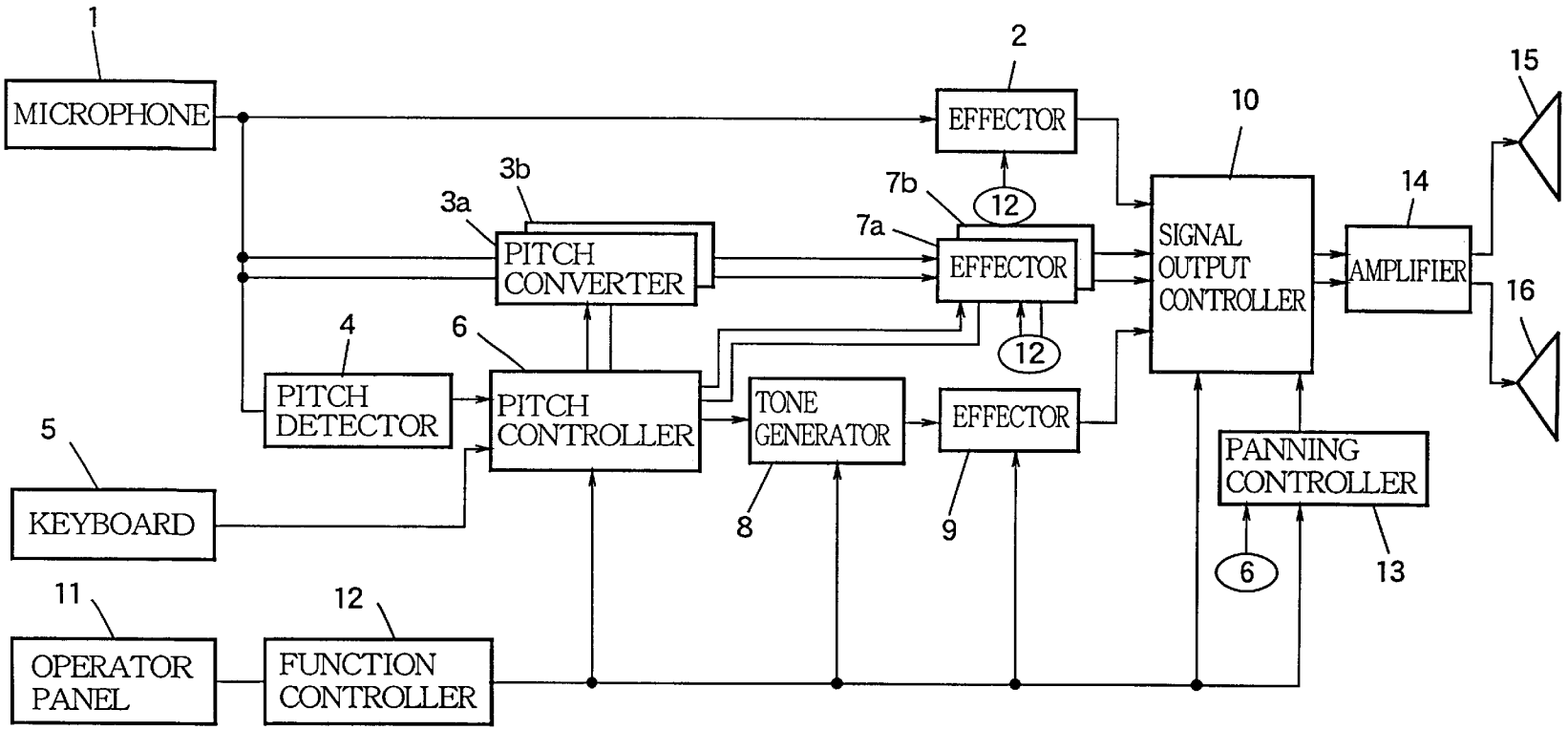
FIG. 1 is a functional block diagram illustrating an audio signal processing apparatus practiced as one preferred embodiment of the invention.

Now, referring to FIG. 1, reference numeral 1 denotes a microphone, reference numeral 2 denotes an effector or effect imparting module, reference numerals 3*a* and 3*b* denote pitch converters, reference numeral 4 denotes a pitch detector, reference numeral 5 denotes a keyboard, reference numeral 6 denotes a pitch controller, reference numerals 7*a* and 7*b* denote effectors or effect imparting modules, reference numeral 8 denotes a tone generator, reference numeral 9 denotes an effector or effect imparting module, reference numeral 10 denotes a signal output controller, reference numeral 11 denotes an operator panel, reference numeral 12 denotes a function controller, reference numeral 13 denotes a panning controller, reference numeral 14 denotes an amplifier, and reference numerals 15 and 16 denote a pair of loudspeakers.

First, an overall constitution of the above-mentioned embodiment will be described. An output of the microphone 1 serving as a voice inputting block is inputted in the effect imparting module 2, the pitch converters 3*a* and 3*b*, and the pitch detector 4 for detecting the pitch of the input voice (hereafter referred to as a vocal pitch). The outputs of the pitch detector 4 and the keyboard 5 are inputted in the pitch controller 6. A first output of the pitch controller 6 is inputted in the pitch converters 3*a* and 3*b*. Outputs of the pitch converters 3*a* and 3*b* and a second output of the pitch controller 6 are inputted in each of the effect imparting modules 7*a* and 7*b*. A third output of the pitch controller 6 is inputted in the tone generator 8 to control the pitch of a music tone. An output of the tone generator 8 is inputted in the effect imparting module 9.

An output of the effect imparting module 2 provides a lead voice signal. Outputs of the effect imparting modules 7*a* and 7*b* provide a first harmony voice signal and a second harmony voice signal, respectively. An output of the effect imparting block 9 provides a music tone signal generated by the tone generator 8. Either of the voice and tone signals may be referred to as "audio signal" if there is no need for distinction between the voice signal such as a singing sound and the tone signal such as a music instrument sound. These output signals are inputted in the signal output controller 10. An output of the operator panel 11 controls the pitch controller 6, the tone generator 8, the effect imparting modules 7*a* and 7*b*, the effect imparting module 9, the signal output controller 10, and the panning controller 13 through the function controller 12. The signal output controller 10 controls output balances among channels of the lead voice, the harmony voice, and the music tone generated by the tone generator 8. For example, the signal output controller 10 alters a mixing ratio and outputs particular one or more of the channels. The panning controller 13 determines the localization of two or more channels, for example, the first and second harmony voices. An output signal of the signal output controller 10 is sent to the loudspeakers 15 and 16 through the stereo amplifier 14.

In the above-mentioned constitution, at least one of the lead voice signal inputted from the microphone 1, the first and second harmony voice signals generated based on the pitch of the input voice, and the tone signal generated by the tone generator 8 is selected for mixing as required and a resultant mixed audio signal is sounded from the loudspeakers 15 and 16. It should be noted that the pitch of the input voice signal can be detected by a technology such as zero-crossing known in the field of speech analysis. The effects to be imparted include a gender specified by the type and depth of voice quality such as male voice and female voice, a vibrato specified by a change ratio of depth and period and a delay time until start of vibrato, a tremolo, a volume, a panning, a detune for detuning of the harmony voices, and a reverberation.

In the embodiment shown in FIG. 1, effects are imparted by the effect imparting modules 2, 7*a*, 7*b*, and 9 for the sake of description. In addition, such effects associated with pitch variation as vibrato and detune can be generated at the time of pitch conversion in the pitch converters 3*a* and 3*b*. Volume and panning effects may be generated in the signal output controller 10. The gender effect is controlled by formant shifting.

In the vocal harmony mode, the components shown in FIG. 1 function as follows. The audio signal processing apparatus having the above-mentioned constitution generates a harmony voice signal based on an input voice and adds the generated vocal harmony voice signal to a lead voice signal, which represents the input voice. At the same time, this apparatus can execute gender control on the lead voice signal and the harmony voice signal. The vocal harmony mode is set from the operator panel 11. Vocal harmonies such as male chorus, female chorus, mixed chorus, country, jazz, a-capella chorus, and bass chorus are prepared beforehand as harmony kits. Selecting a desired harmony kit from the operator panel 11 allows the user to collectively set many parameters through the function controller 12.

The vocal pitch of the singing input voice of the singer or the user inputted from the microphone 1 is detected by the pitch detector 4. Receiving the output of the pitch detector 4 and the pitch specification from the keyboard 5, the pitch controller 6 controls the pitch converters 3*a* and 3*b*. Receiving the signal indicative of the user's singing voice, the pitch converters 3*a* and 3*b* convert or shift the pitch of this signal into a desired pitch. Then, the effect imparting modules 7*a* and 7*b* impart an effect to the pitch-converted signals to generate the first and second harmony voice signals. It should be noted that the number of harmony voice signals is not necessarily limited to two. It may be one or three or more.

The operator panel 11 and the function controller 12 are adapted to separately set the effects to be imparted to the user's singing voice signal and the effects to be imparted to the first and second harmony voice signals. This arrangement allows the user to have the effect imparting modules 7*a* and 7*b* impart effects in a manner different from the effect imparting module 2 so that the types or degrees of effects to be imparted by the effect imparting modules 7*a* and 7*b* can be changed. For example, the effect is made deeper on the lead voice signal than the harmony voice signal. The random panning effect may be applied to the harmony voice signal while a localized image position is kept unchanged on the lead voice signal. In default setting by the function controller 12, the effect imparting modules 7*a* and 7*b* always impart effects that are different from those to be imparted by the effect imparting module 2. This arrangement can generate highly defined harmony voices over the original voice of the user.

In the first aspect of the invention, the audio processing apparatus is constructed for generating an auxiliary audio signal such as the harmony voice signal based on an original audio signal such as the input voice signal and mixing the auxiliary audio signal to the original audio signal. In the inventive apparatus, a control section composed of the pitch controller 6 designates a pitch of the auxiliary audio signal. A processing section including the pitch converters 3*a*, 3*b* and the effect imparting modules 7*a*, 7*b* processes the original audio signal under control of the control section to generate the auxiliary audio signal having the designated pitch, and applies a first effect to the generated auxiliary audio signal. An effector section composed of the effect imparting module 2 applies a second effect different from the first effect to the original audio signal. An output section composed of the signal output controller 10 outputs the original audio signal applied with the second effect concurrently with the auxiliary audio signal applied with the first effect.

The pitch controller 6 also provides capabilities of controlling the effect imparting modules 7*a* and 7*b* to change the types of effects and vary the degrees of effects to be imparted to the harmony voice signals according to the difference between pitches before and after the conversion, or the difference between the vocal pitch of the input voice and the pitch of the converted harmony voice signal. Namely, the inventive audio processing apparatus is constructed for generating an auxiliary audio signal such as the harmony voice signal based on an original audio signal such as the input voice signal. In the inventive apparatus, a detecting section in the form of the pitch detector 4 detects an original pitch of the original audio signal. A processing section including the pitch converters 3*a*, 3*b* and the effect imparting modules 7*a*, 7*b* carries out a pitch conversion of the original audio signal based on the detected original pitch to generate the auxiliary audio signal having a converted pitch, and applies an effect to the generated auxiliary audio signal. A control section in the form of the pitch controller 6 controls the processing section to alter the effect applied to the auxiliary audio signal dependently on a difference between the original pitch of the original audio signal and the converted pitch of the auxiliary audio signal. Consequently, the present embodiment can impart a variety of effects to the harmony voice signals and automatically impart appropriate effects to the harmony voice signals in correspondence with the pitch difference from the user's voice.

It should be noted that, in the functional block diagram of FIG. 1, there is no distinction between analog signal processing and digital signal processing for ease of understanding, so that none of A/D and D/A converters is illustrated. In practice, the analog signal of the microphone 1 is converted by an A/D converter, not shown, into a digital signal before being sent to the effect imparting module 2 and so on. In the signal output controller 10, the outputs of the effect imparting modules 2, 7*a*, 7*b*, and 9 are weighted and added together in a digital manner and outputted to the amplifier 14 through a D/A converter, not shown.

Figure 2A:
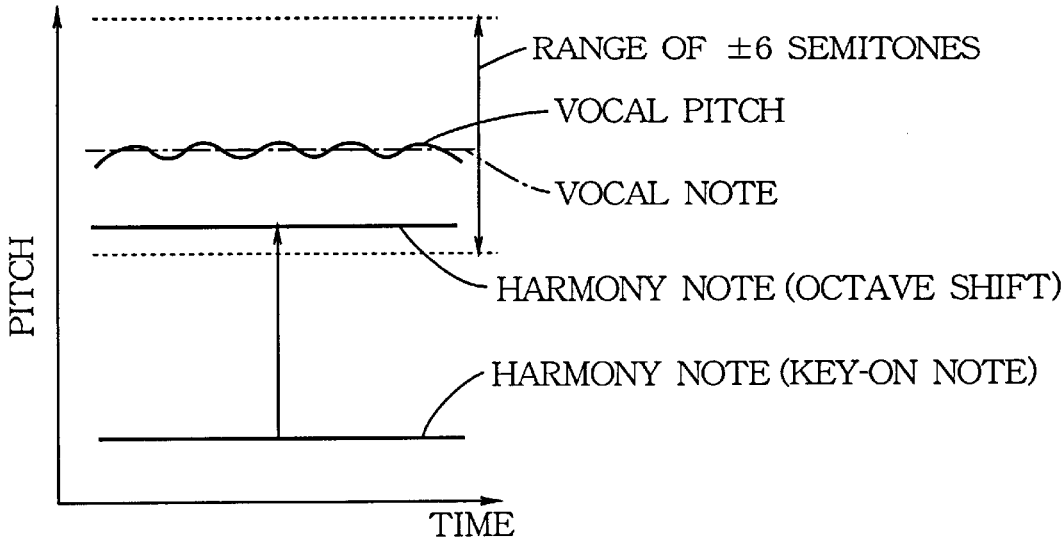
FIGS. 2A through 2C are graphs illustrating particular examples of vocal harmony modes.

The following describes a particular example of the vocal harmony mode. FIG. 2A shows a relationship between voice signals in the vocoder harmony mode. When the keyboard 5 is played at the time the user inputs his or her voice into the microphone 1, the harmony pitch matching the pitch corresponding to the operated key (key-on note) is added to the lead voice or the original voice to create the harmony voice signal, and the result of the addition is sounded. The timbre of this harmony voice signal is user's "own voice" and therefore the user feels as if he or she is playing a musical instrument of this timbre on the keyboard 5. The period in which this harmony voice is sounded is controlled by pressing of a corresponding key of the keyboard 5. Setting a sounding form by the operator panel 11 allows the generation of a harmony voice continued from key-on to key-off like the organ in a sustain period. This also allows the generation of a decay sound for a predetermined period from key-on like the piano. Selecting the vocoder type from the operator panel 11 allows transposition of the harmony note to be sounded from the pitch of the key-on note specified on the keyboard 5. In automatic setting, the shift amount can be set so that the pitch falls within a range of ±6 semitones around the vocal note of the input voice. It should be noted that, in the pitch controller 6, if the vocal pitch exceeds a semitone above or below the previously computed note, the note having the nearest pitch found by waveform comparison is used as the vocal note.

Figure 2B:
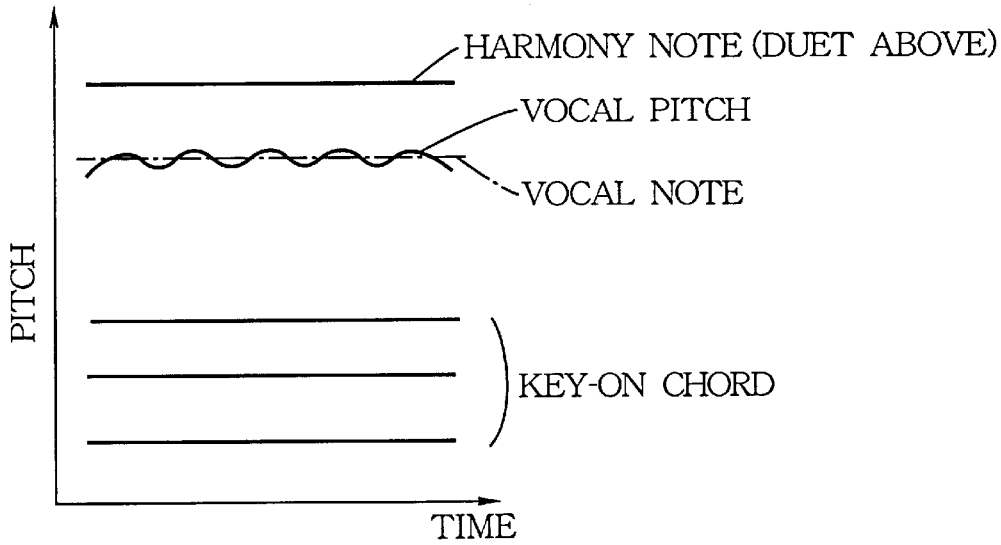

FIG. 2B shows a relationship between the original and harmony voice signals in the chordal harmony mode. The user inputs his or her original voice from the microphone 1 and, at the same time, specifies a chord on the keyboard 5. Recognizing the type of the specified chord, the pitch controller 6 adds the harmony pitch matching the pitch name constituting this chord to the lead voice and sounds the resultant harmony voice. Namely, only inputting the user's voice creates a harmony sound according to the chord specified on the keyboard 5. For example, when the chord is C major, the harmony voice has the pitch of C, E, or G. If setting is made on the operator panel 11 such that an immediately above note is sounded (duet above), the harmony voice is sounded in the harmony note of E if the pitch of the input voice is C. In the chordal harmony mode, once a chord is established, only inputting an original or lead voice automatically creates the harmony voice of the lead voice without operating the keyboard 5. Also, the chord specification can be changed from the keyboard 5 in synchronization with the progress of music.

Figure 2C:
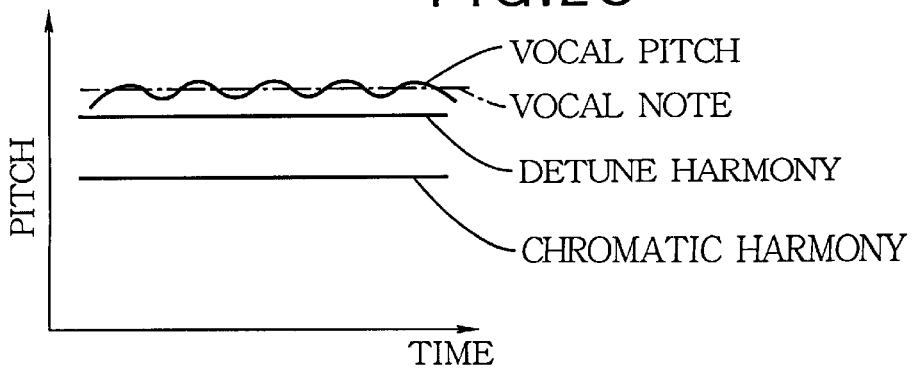

FIG. 2C shows a relationship between the lead and harmony voice signals in the detune harmony mode and the chromatic harmony mode. In the detune harmony mode, a harmony voice obtained by slightly shifting the vocal pitch or vocal note of the lend voice is sounded (this is known as a chorus effect). The amount of detuning is variable by ± several cents to ±20 cents by switching detune types. In the chromatic harmony mode, a harmony voice is obtained by shifting the vocal pitch or vocal note of the lead voice by a fixed amount of pitch. The amount of pitch shift is variable by about ±1 octave from unison.

The following describes a manner by which the effect imparting modules 7*a* and 7*b* are controlled by the pitch controller 6. According to the difference between the vocal pitch of the user's voice and the pitch of the pitch-converted harmony voice (namely the harmony note), the parameter value of the effect to be imparted to the harmony voice signal is varied. The vocal pitch may be a pitch of the rounded vocal note derived from the input voice.

Figure 3A:
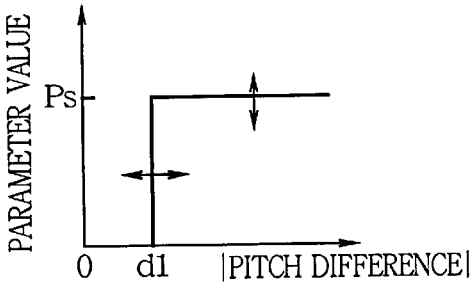
FIGS. 3A through 3E are graphs illustrating control patterns of an effect imparting module or effector through a pitch controller.
Figure 3B:
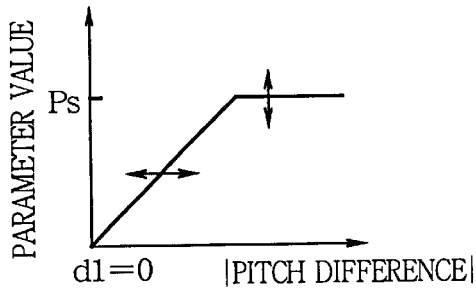
Figure 3C:
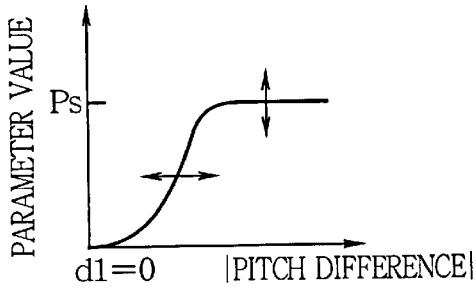
Figure 3D:
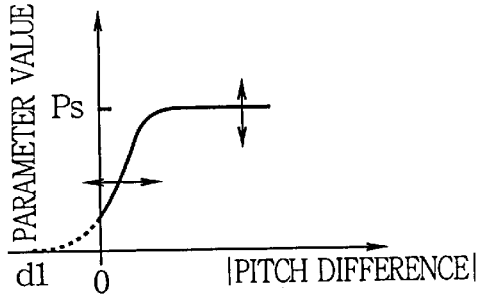

FIG. 3A shows an example in which a certain amount of effect expressed by a parameter value Ps is imparted when the absolute value of pitch difference exceeds a certain threshold d1. The values d1 and Ps can be variably set from the operator panel 11 and the function controller 12. FIG. 3B shows an example in which an effect begins to take when the pitch difference exceeds a certain threshold d1 (in this example, pitch difference d1=0). The parameter value subsequently rises in proportion to the absolute value of the pitch difference, and then the parameter value becomes Ps, thereby saturating the effect. FIG. 3C shows an example in which, after an effect begins to take, the increase ratio rises for the absolute value of the pitch difference and the parameter value becomes Ps, thereby saturating the effect. FIG. 3D shows an example in which the threshold value d1 is set to the negative side. In this case, any parameter values in the area in which the absolute value of the pitch difference becomes negative are not used.

Figure 3E:
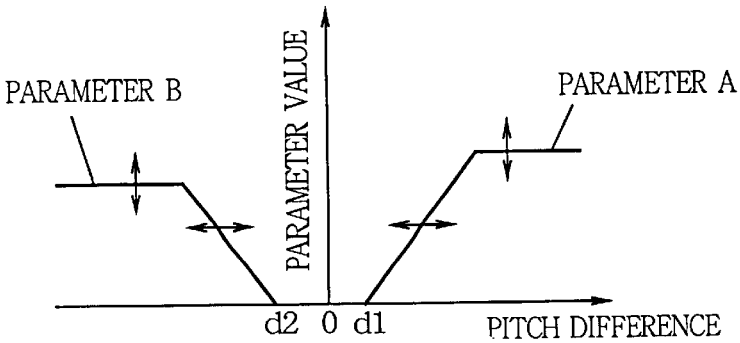

FIG. 3E shows an example in which the effect types depend on positive and negative pitch differences. When the pitch of a harmony voice is set upward by one octave by operating the 1-octave-up key of the keyboard 5 relative to the pitch of a low octave being sung by a male singer, leaving the voice quality of the harmony voice in the male voice state causes a feeling of disagreeableness. To prevent this problem from occurring, gender control is executed to convert the harmony voice into a female voice. Conversely, when the pitch of the harmony voice is specified downward by one octave by a 1-octave-down key of the keyboard 5 relative to the pitch of a high octave being sung by a female, gender control is also executed to convert the harmony voice into a male voice. In an example shown in FIG. 3E, if the harmony note is higher than the vocal pitch of the input voice by exceeding the threshold d1, gender control is executed so that the harmony voice is converted into a female voice as indicated by parameter A. If the harmony note is lower than this, going below threshold d2, gender control is executed so that the harmony voice is converted into a male voice as indicated by parameter B. At the same time, the parameter value is increased according to the pitch difference to deepen the gender control.

In the above-mentioned examples, the parameter value increases according to the pitch difference. Conversely, the parameter value decreases or fluctuates between increase and decrease in some cases. Plural effects can be simultaneously imparted to one harmony voice. In such a situation, a lookup table indicative of a relationship between the above-mentioned pitch difference and the effect parameter (the values of thresholds d1 and d2 and the saturation value Ps) may be appropriately selected according to the imparted effects. This allows to change the types and degrees of effects to be imparted according to the difference between the vocal pitch of the user's voice or the pitch of the vocal note and the pitch of the harmony voice signal. It should be noted that, instead of using the above-mentioned lookup table, functions of the parameter values to the pitch difference may be stored in an appropriate storage device to provide the effect parameter values by computation. Execution of effect control on the harmony voice signal by the pitch difference can provide a unique effect type and degree different from those for the effect imparted to the lead voice signal. Moreover, not only the pitch of the harmony voice signal but also the effect for the harmony voice signal can be varied from time to time by operating the keyboard 5 as the music progresses.

Figure 4A:
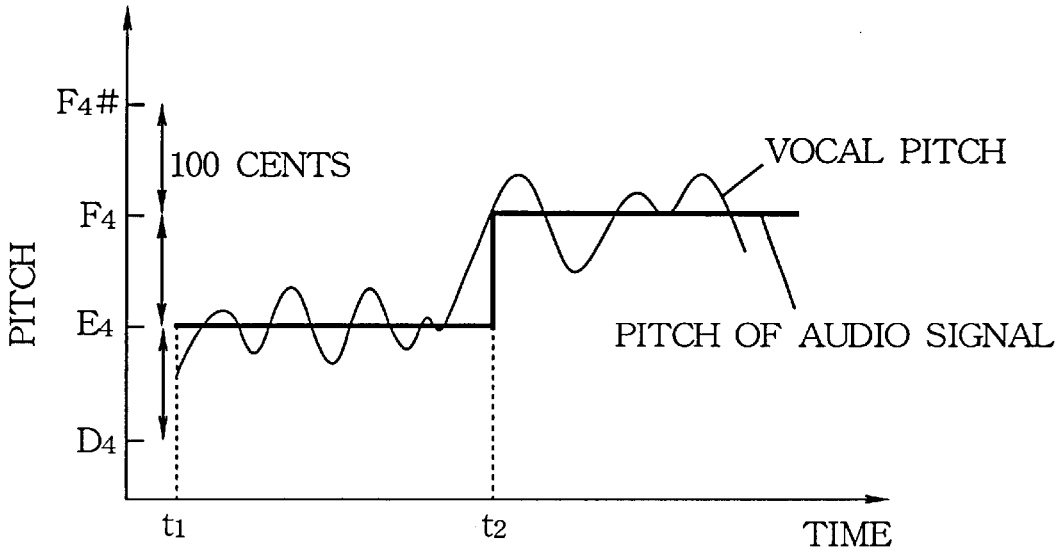
FIGS. 4A and 4B are graphs illustrating pitch-to-note conversion modes.
Figure 4B:
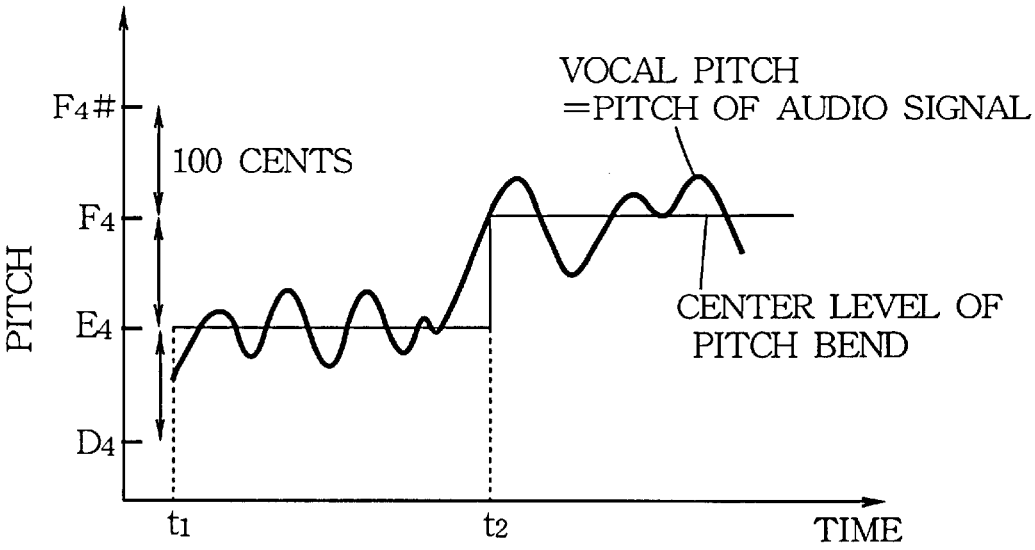

The following describes the pitch-to-note mode. FIG. 4A shows a first processing mode and FIG. 4B shows a second processing mode. It should be noted that the vocal pitches of these figures are shown for the sake of description and therefore do not necessarily match actual vocal pitches. In this pitch-to-note mode, a music tone of any given timbre is outputted by use of the pitch of the input voice signal.

Now, with reference to FIGS. 4A and 4B, the pitch-to-note conversion processing will be described based on the functional block diagram of FIG. 1. In the above-mentioned preferred embodiment, information about note-on, note-off, pitch bend, and portamento control is generated based on the vocal pitch, thereby generating the tone signal of a specified timbre. Based on the output of the pitch detector 4, the pitch controller 6 has operates a pitch name identifying block for quantizing the vocal pitch shown in FIGS. 4A and 4B to a particular pitch name, and a operates pitch bend processing block for executing pitch bend processing according to the difference between the vocal pitch and the pitch of the identified pitch name, thereby controlling the pitch of the tone signal to be outputted from the tone generator 8.

In the first processing mode shown in FIG. 4A, the difference between the vocal pitch and pitches of plural pitch names defined beforehand is detected and the pitch of a tone signal is identified to the pitch of a particular pitch name. To be more specific, the vocal pitch is identified by a method such as rounding to the pitch name of the nearest pitch in the plural pitch names defined in a resolution of semitone (100 cents), and the pitch of this pitch name is used as the pitch of the tone signal. It should be noted that this processing will be described later with reference to a flowchart shown in FIG. 15. This pitch is related to a note number. This pitch matches the pitch of the vocal note shown in FIG. 2.

In the second processing mode shown in FIG. 4B, a pitch that varies with the vocal pitch is used as the pitch of a tone signal. For this tone signal pitch, the vocal pitch that fluctuates as shown in FIG. 4B is used without change. Alternatively, a vocal pitch averaged for a short period in which a slight pitch variation in the vocal pitch disappears is used. Anyhow, rather than using a discrete pitch on a 100-cent basis such as a pitch defined as a pitch name, the pitch of a tone signal is made variable continuously.

The above-mentioned first and second processing modes are selected before starting the pitch-to-note processing as desired by the user. It is more preferable if the pitch controller 6 switches between these processing modes only by operating the operator panel 11 during the pitch-to-note processing. This facilitates the selection during the singing performance. Arranging such a selector switch in the grip of the microphone 1 further enhances ease of operation.

In the second aspect of the invention, the audio processing apparatus is constructed for generating a synthetic audio signal such as the music tone signal in response to an original audio signal such as the input voice signal. In the inventive apparatus, a detecting section composed of the pitch detector 4 sequentially detects a pitch of the original audio signal. A generating section composed of the tone generator 8 generates the synthetic audio signal having a pitch varying in response to that of the original audio signal. A control section composed of the pitch controller 6 operates in a first mode for quantizing the detected pitch of the original audio signal into a sequence of notes to control the generating section such that the pitch of the synthetic audio signal varies stepwise in matching with the sequence of the notes, and operates in a second mode for controlling the generating section according to the detected pitch of the original audio signal such that the pitch of the synthetic audio signal continuously varies to duplicate that of the original audio signal. A switch section such as the operator panel 11 switches the control section between the first mode and the second mode. Preferably, the switch section can switch the control section while the generating section is generating the synthetic audio signal.

The note-on timing of a tone to be generated by the tone generator 8 is set to a point at which the pitch of the input voice signal can be detected by the pitch detector 4. The note-off timing is set to a point at which the pitch of the input voice signal cannot be detected by the pitch detector 4 any more. Unless the level of the input voice exceeds a predetermined level, the pitch detector 4 cannot detect the pitch, so that the note-on and note-off timings substantially depend on the intensity or volume of the input voice. It should be noted that a block for detecting the intensity of the input voice may be provided separately from the pitch detector 4.

This block detects note-on when the intensity of the input voice exceeds a first predetermined level, and detects note-off when the intensity falls below a second predetermined level. The first predetermined level and the second predetermined level may be the same. It is also practicable to use a switch device to instruct the note-on and note-off timings by turning on/off this switch device. In addition, it may be arranged that the pitch-to-note processing is enabled only while a key or a button switch on the keyboard 5 is kept pressed. This prevents such an error operation from happening as generating a tone in response to a noise caused while no signal is inputted.

The tone signal generated by the tone generator 8 is inputted in the signal output controller 10 through the effector or effect imparting module 9. It may be arranged so that only the tone signal generated by the pitch-to-note processing is outputted from the signal output controller 10. Also, the tone signal can be outputted in the form of MIDI (Musical Instrument Digital Interface) data to an externally attached MIDI equipment through a MIDI OUT terminal provided on the present embodiment.

The following describes the second processing of pitch-to-note conversion with reference to FIG. 4B and FIG. 1. When a vocal pitch is varied continuously and the difference between the pitch of the identified pitch name and the vocal pitch exceeds a predetermined range, the pitch name identifying block reidentifies the pitch name of the tone signal to a new pitch name and, at the same time, controls the tone generator 8 such that a tone signal having an amplitude envelope with no attack portion is generated.

The pitch detector 4 starts outputting the vocal pitch at time t1 shown in FIG. 4B, determines that the pitch name or musical note nearest to the value of the vocal pitch is E4, which provides a reference pitch, and outputs a note-on event. Alternatively, the pitch detector 4 determines by quantization that E4 is the pitch name nearest to the value of the vocal pitch at the note-on event when the block for detecting the intensity of the input voice signal detects start of sounding or at time t1 of note-on instructed from the above-mentioned switch, thereby providing the reference pitch name. It should be noted that, the pitch detector 4 may output the note-on of the pitch name E4 when the vocal pitch becomes the pitch of the pitch name E4 immediately after the above-mentioned time t1.

The pitch controller 6 outputs the note number of the pitch name E4 corresponding to this vocal pitch and, at the same time, controls the tone generator 8 to execute note-on processing. Then, when the vocal pitch fluctuates, the pitch controller 6 executes pitch bend processing according to the difference between the vocal pitch and the pitch name identified as the reference pitch. In other words, the sound is allowed to continuously vary by having the pitch of the tone signal exactly follow the vocal pitch by the pitch bend processing around the reference pitch of the pitch name E4 being the center pitch. In the example shown, however, the pitch bend range is set to a level of ±100 cents with respect to the pitch of each pitch name. Hence, the pitch bend processing alone cannot generate a tone when the pitch continuously varies without interruption to go over the pitch bend range.

For this reason, resounding of the tone is required in which the vocal pitch continuously varies without interruption to go over the pitch bend range. At time t2 shown in FIG. 4B, when the difference between the pitch of the identified pitch name E4 and the vocal pitch goes over the pitch bend range, the pitch controller 6 outputs a resound instruction to the tone generator 8 to mute the above-mentioned first tone signal of the pitch name E4, and to resound the tone signal in a newly identified pitch name F4. In other words, the pitch controller 6 controls the tone generator 8 such that the note of the pitch name E4 that turns on at time t1 turns off at time t2 and the vocal pitch is redefined to the new pitch name F4, making the tone generator 8 newly generate the tone of the pitch name F4. Also when the vocal pitch becomes the pitch of the pitch name F4, the pitch of the tone signal is made to follow the vocal pitch by the pitch bend processing with the pitch of the pitch name F4 being the center pitch in the fluctuation range of ±100 cents. In other words, the note of the center pitch providing the reference of the pitch bend is sequentially changed as the music progresses and the bridge between the successive notes is processed by the pitch bend. Thus, making the pitch of the tone signal follow the vocal pitch can continuously vary the pitch of the tone signal in generally the same manner as the vocal pitch.

In the third aspect of the invention, the audio processing apparatus is constructed for generating a synthetic audio signal such as the music tone signal in response to an original audio signal such as the input voice signal. In the inventive apparatus, a detecting section composed of the pitch detector 4 detects a varying pitch of the original audio signal. A generating section composed of the tone generator 8 generates the synthetic audio signal. A control section composed of the pitch controller 6 controls the generating section to vary a pitch of the synthetic audio signal according to the detected varying pitch of the original audio signal. As shown in FIG. 4B, the control section determines a first note E4 from the detected varying pitch of the original audio signal for controlling the generating section to generate the first note of the synthetic audio signal while bending a pitch of the synthetic audio signal around the first note E4 in response to a deviation of the detected varying pitch from the first note E4. Then, the control section determines a second note F4 from the detected varying pitch when the deviation thereof from the first note E4 exceeds a predetermined value for controlling the generating section to stop the first note E4 and to generate the second note F4 of the synthetic audio signal.

Preferably, the generating section generates the first note E4 and the second note F4 which has an amplitude envelope substantially the same as that of the first note E4. Portamento control specified in XG format of MIDI is used for the above-mentioned processing when the detected vocal pitch continuously varies and sounding of the pitch exceeding the pitch bend range becomes necessary. This portamento control allows to output the new pitch name F4 from the tone generator 8 as a tone having an amplitude envelope with no attack portion. It should be noted that, generally, the amplitude envelope is divided into attack, decay, sustain, and release portions. The attack portion delays the rise of an amplitude envelope and causes an overshoot. Therefore, it is desired to eliminate the attack portion when bridging two tones. If the attack portion is eliminated, the magnitudes of the amplitude envelopes before and after the resounding match each other. The note of the pitch name E4 can be easily linked to the note of the pitch name F4, making the resounding inconspicuous. It should be noted that, although the decay portion of the preceding pitch name E4 is normally inconspicuous, if it is conspicuous in some unusual situation, it is also desirable to make the decay portion inconspicuous. It should also be noted that, even if an amplitude envelope has the attack portion, the same can be cross-faded with the decay portion of the tone of the preceding pitch name E4 to approximately match the sizes of the amplitude envelopes of the tone signal before and after the resounding, thereby bridging these amplitude envelopes with ease.

If the pitch bend range is set to zero, no pitch bend operation is substantially executed, only outputting a result obtained by the pitch quantization on a semitone basis.

Therefore, setting the pitch bend range to zero simply executes the first processing mode. This allows the user to simply switch between the first and second processing modes only by changing the pitch bend range settings. In doing so, the amplitude envelopes in which the pitch name is defined according to the continuous variation of the vocal pitch can also be switched in an associative operation with the switching of the first and second processing modes.

As described above, when generating a tone of which pitch is controlled based on the pitch of the input voice in the pitch-to-note processing, the user can select as desired a performance in which the pitch varies stepwise according to the pitch name and another performance in which the pitch varies smoothly by following or duplicating the pitch of the input voice. While singing a song, the user can switch in real time between the manners in which the pitch of a tone varies in different ways. As long as no singing voice is captured in a recording/reproducing device, the user can sing again and again until a desired pitch of a tone signal is obtained.

It should be noted that the intensity of the tone signal is set by the operator panel 11, so that the setting remains unchanged during the performance. This sometimes produces a monotonous tone deprived of powerfulness. In other words, so far, a preset envelope has been imparted to each key-on event, making a monotonous tone to be generated. To overcome this drawback, there are provided an additional detector for detecting the intensity of the input voice signal and an additional controller for controlling the intensity of the synthetic tone signal based on the intensity of the detected input voice signal in proportion to the intensity of the detected input voice signal. These detector and controller can control the pitch and intensity of the tone signal based on the vocal pitch and intensity of the input voice signal. This allows a powerful performance with a variation imparted to every key-on event and allows a reflection of singer's feeling by the intensity of the tone signal. Every tone signal is outputted with an envelope having a predetermined shape attached. The intensity (or an coefficient to be multiplied by an amplitude envelope) of the tone signal is determined by the sound intensity or volume of the input voice signal. If the tone signal is outputted to an external device in the form of MIDI data, the tone signal can be outputted as note-on velocity data.

The inventive audio processing apparatus is constructed for generating a synthetic audio signal such as the music tone signal in response to an original audio signal such as the input voice signal. In the inventive apparatus, a detecting section in the form of the pitch detector detects a pitch of the original audio signal. Another detecting section such as the above mentioned additional detector detects a volume of the original audio signal. A generating section composed of the tone generator 8 generates the synthetic audio signal. A control section composed of the pitch controller 6 controls the generating section to vary a pitch of the synthetic audio signal according to the detected pitch of the original audio signal. Another control section such as the above mentioned additional controller controls the generating section to vary a volume of the synthetic audio signal according to the detected volume of the original audio signal.

Figure 5A:
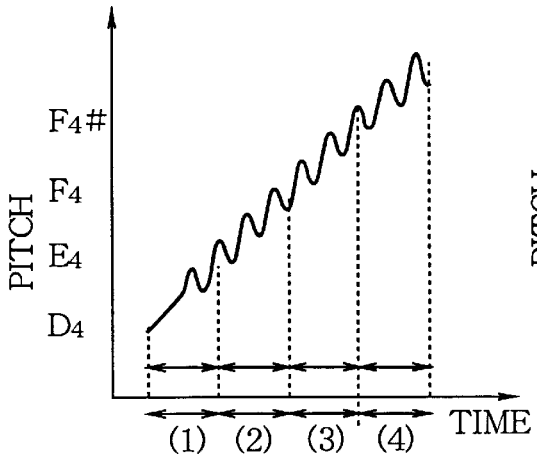
FIGS. 5A and 5B are graphs illustrating manners by which a delay effect is imparted to a plurality of plural continuously generated tone signals.
Figure 5B:
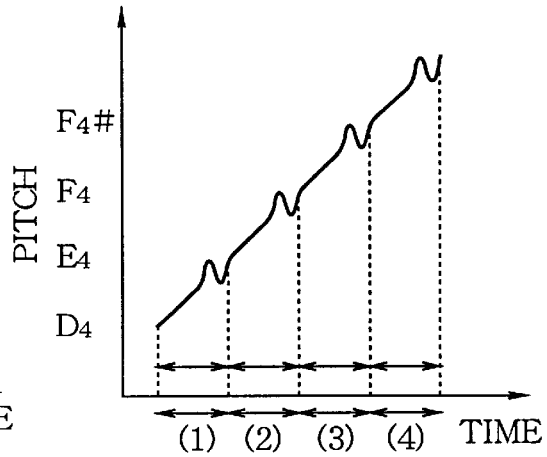

In the second processing mode shown in FIG. 4B, to make the pitch of the tone signal continuously vary, the portamento control is executed to change note numbers, thereby resounding plural tones continuously. Namely, at the time the first note goes to note-off state, the next note goes to note-on state, thereby continuously generating the sound while continuously varying the pitch. On the other hand, so-called delay effects are provided for starting to impart an effect to a tone signal after a preset delay from generation of that tone signal. The delay effects include delay vibrato and delay tremolo for example. FIGS. 5A and 5B are diagrams for describing the application of the delay effect to continuously generated tone signals. FIG. 5A illustrates an operation of the present embodiment. FIG. 5B illustrates a delay effect imparting operation of related-art. These figures show the delay vibrato as an example. For ease of understanding, the period and depth of the vibrato are different from those of vibrato actually practiced.

Referring to FIG. 5B, plural tone signals (1) through (4) may be continuously sounded to continuously vary the pitch. At the time the tone signal (1) goes to note-off, the tone signal (2) comes to note-on. This holds true with the subsequent tone signals (2) through (4). If an attempt is made to impart the delay vibrato to these continuous tone signals (1) through (4), effect application to the first tone (1) starts after a predetermined time from the note-on of the first tone (1), and stops upon ending or note-off of the first tone. For the subsequent continuous tone signals (2) through (4), the effect application stops every time each tone ceases. Consequently, the effect on the tones (1) through (4) that should form one continuous sound in performance becomes intermittent, thereby giving a feeling of disagreeableness.

The following describes the application of the delay vibrato to tones continuously sounded in the present embodiment with reference to FIG. 5A. Once the effect application to the first tone (1) starts after a predetermined time with a delay, the effect application remains continued even when the first tone dumps. When the subsequent continuous tones (2) through (4) are generated, new effect application is prevented from starting. Consequently, the delay vibrato applied to the continuous tones (1) through (4) that should substantially form one continuous sound in the music performance is not interrupted even if the tone signal change takes place halfway through the performance. This allows the generation of continuous tones imparted with the delay vibrato that causes no feeling of disagreeableness.

In the fourth aspect of the invention, the audio processing apparatus is constructed for applying an effect such as the delay vibrato to an audio signal such as the music tone signal. In the inventive apparatus, a generating section composed of the tone generator 8 is controlled to generate the audio signal for creating either of a continuous sequence of music notes and a discrete sequence of music notes. An effector section composed of the efect imparting module 9 is triggered in response to an occurrence of each music note for applying a time-varying effect to each music note of the generated audio signal. A control section composed of the function controller 12 operates when the generating section generates the continuous sequence of the music notes including a first music note (1) and subsequent music notes (2) to (4) for controlling the effector section to maintain the time-varying effect once applied to the first music note (1) even after the first music note (1) ceases so that the time-varying effect is continuously applied to the subsequent music notes (2) to (4) while preventing further time-varying effects from being triggered in response to the subsequent music notes (2) to (4). Preferably, the effector section starts application of the time-varying effect to the music note with a predetermined delay of time after the generating section starts generation of the music note.

Referring to FIG. 1 again, in order to achieve the above-mentioned effect imparting operation, the effect imparting module 9 sustains an effect started by the generation of the first tone signal (1) while the tone generator 8 is continuously generating the tone signals starting after the first tone signal (1), and prevents the effect application from starting when the subsequent tone signals (2) through (4) are generated continuously. In the above description, plural tones are continuously sounded without overlapping each other. The same advantage as described above may be obtained by imparting a delay effect to plural tones that are recognized as a sequence of continuous tones. These tones may overlap with each other or be slightly separated from each other in a sounding period.

While the pitch-to-note mode is described in the foregoing, the normal performance mode of an electric musical instrument may also be used. The portamento effect in the normal performance mode continuously shifts the pitch of a tone generated in response to a note-on event caused by operating the keyboard 5, from the pitch of another tone sounded in response to a previous note-on event, to the pitch specified by the newly pressed key. In a system where the portamento effect is set before starting a performance, the portamento effect normally takes during the performance. In some cases, the portamento effect is provided by turning on a next key before turning off the current key during the music performance, or by playing legato. A variation to the above-mentioned portamento effect is a glissando effect in which, instead of continuous pitch shifting, the pitch of a tone is shifted on a semitone or whole tone basis. If a delay effect is imparted while the portamento-effected performance is controlled, like advantage can be obtained by like processing.

Figure 6:
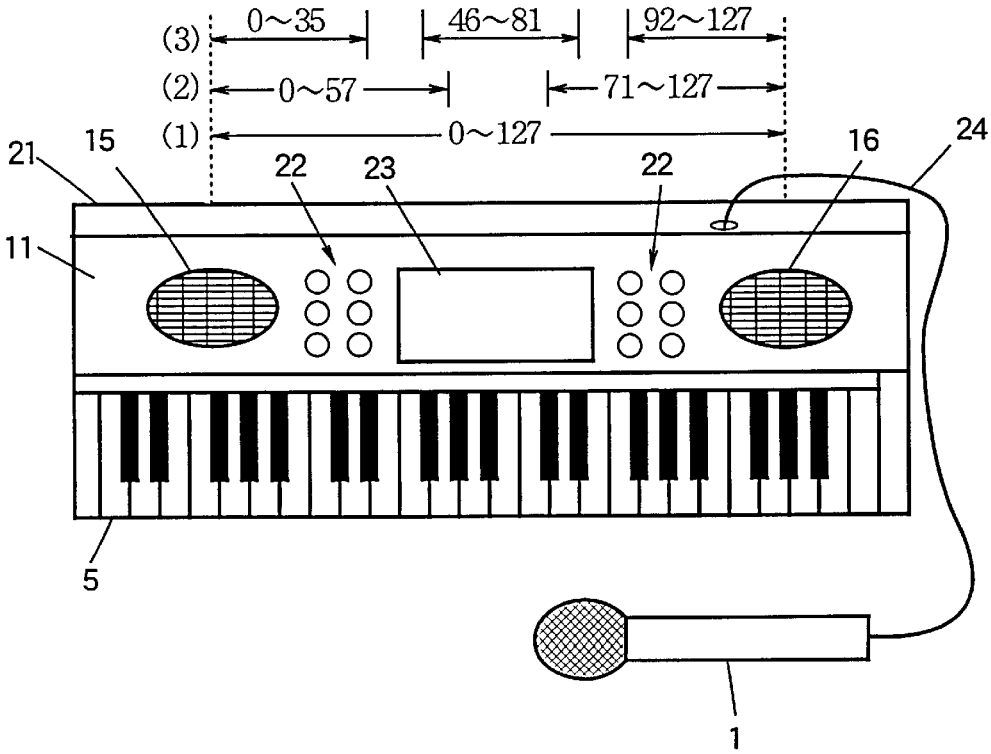
FIG. 6 is an external view illustrating an appearance of the preferred embodiment shown in FIG. 1.

FIG. 6 shows an external view of the preferred embodiment of the audio signal processing apparatus associated with the present invention. With reference to FIG. 6, components similar to those previously described with FIG. 1 are denoted by the same reference numerals. In the figure, reference numeral 21 denotes a main frame of an electronic musical instrument, reference numeral 22 denotes a group of controls, reference numeral 23 denotes an display, and reference numeral 24 denotes a connection cord. The main frame 21 has the keyboard 5 and the left-side and right-side loudspeakers 15 and 16, allowing the user to make the music performance all with this setup. The operator panel 11 has the group of controls 22 and the display 23. The display 23 displays the settings made by means of the controls and displays the harmony kits before described. The connection cord 24 connects the microphone 1 to the main frame 21. The main frame 21 has a MIDI terminal for providing connection of the main frame to an external MIDI device such as a sequencer. The main frame 21 may also have a pitch bend wheel and a modulation wheel as required.

The following describes, with reference to FIG. 6, a random panning operation that is executed by the panning controller 13 shown in FIG. 1. The panning control determines sound image localization. To be more specific, the sound image localization is realized by controlling a volume ratio between the L and R channels of the amplifier 14 that drives the left-side and right-side loudspeakers 15 and 16. While the panning control is shown in the foregoing separately from the effect imparting modules 2, 7*a*, 7*b*, and 9, the panning control is a type of effect application. In FIG. 6, the numerals shown in the ranges (1), (2), and (3) are volume ratios between the L and R channel signals, or values in proportion to the L channel volume/(L channel volume+R channel volume), indicating localized sound image positions in the horizontal direction. In the shown example, panning is set by a range of numerals 0 to 127 shown in the range (1), 0 being indicative of the leftmost localized position and 127 being indicative of the rightmost localized position. When 0 is specified, the localization is made extreme left, no sound being heard on the right-hand side. On the other hand, when 127 is specified, the localization is made extreme right, no sound being heard on the left-hand side.

Conventionally, the random panning is performed as a sort of an acoustic effect in which a tone signal is localized in a random fashion. For example, a tone signal played by the user is heard from random positions, a left-hand position at one time and a right-hand position at another, for example, every time a key is pressed. However, an attempt to localize sound images of plural tone signals in a random fashion incidentally localizes plural sound images at the same position. If this happens, the tone signals are clustered at one point to thereby suddenly narrowing the sound field. If the plural sound images are localized at the center point, the sound field is extremely narrowed.

In the audio signal processing apparatus shown in FIG. 1, the panning controller 13 controls the localization of the sound images of first and second harmony voice signals in a time sequence and in a random fashion. The whole range (1) of 0 to 127 for localizing the sound images of the first and second harmony voice signals may be divided into plural regions as indicated by range (2), which is divided into two regions of 0 to 57 and 71 to 127, and range (3), which is divided into three regions of 0 to 35, 46 to 81, and 92 to 127. The panning controller 13 has a localized position determining block for determining the localized positions of plural tone signals for every predetermined period in a predetermined region in a random fashion, and a storage block for storing information about the localized positions of the plural tone signals determined by the localized position determining block, the information being the numerals indicative of the above-mentioned localized positions or the numbers identifying the above-mentioned regions to which the localized positions belong. Based on the information about the localized positions stored in the storage block, the localized position determining block specifies all the regions that do not include the already determined localized positions within the above-mentioned predetermined whole range. By determining the localized positions for the first and second harmony voice signals such that these localized positions are not concentrated at the same position, the panning controller 13 can impart the stable random panning effect.

In the fifth aspect of the invention, the audio processing apparatus is constructed for locating a plurality of audio signals such as the first and the second harmony signals to a plurality of regions. In the inventive apparatus, an input section including the effect imparting module 7*a* and 7*b* provides the plurality of the audio signals concurrently with each other. An output section including the signal output controller 10 mixes the plurality of the audio signals with each other while locating the plurality of the audio signals to the plurality of the regions. A control section composed of the panning controller 13 controls the output section to randomize the locating of the audio signals. The control section comprises a determination sub section or the above mentioned localized position determining block that randomly assigns one region to one of the audio signals, a memory sub section or the above mentioned storage block that memorizes said one region assigned to said one audio signal, and another determination sub section that randomly assigns another of the regions except for said memorized region to another of the audio signals to thereby avoid duplicate assignment of the same region to different ones of the audio signals while ensuring randomization of the locating of the audio signals.

For example, let the range in which the sound images of the first and second harmony voice signals are localized be the two separate regions 0 to 57 and 71 to 127 as shown in range (2). For the localized position of the first harmony voice signal, a value is selected from 0 to 57 or 71 to 127 in a random fashion at a certain point of time. Let the value be 40 for example. For the localized position of the second harmony voice signal, another value is selected from 71 to 127 in a random fashion at the same point of time. Let the value be 100 for example. In other words, for every predetermined period, the localized position of one of the first and second harmony voice signals is determined in a random fashion. Then, the position at which the other harmony voice signal is localized is determined in one of the regions excluding the region in which the former harmony voice signal is localized. If the number of tone signals to be localized increases, sequentially repeating the random determination of localized positions for the tone signals in the regions except those in which localized positions are already determined can prevent the plural tone signals from being concurrently localized in the same region. This processing will be described later in more detail with reference to a flowchart shown in FIG. 16. It should be noted that the above-mentioned predetermined period may be set to a certain duration of time or a period from the key-on to key-off of one note.

In this case, the range in which the sound images of the first and second harmony voice signals are localized is set such that the two or three regions shown in range (2) or (3) are adjacently set and separated from each other by a predetermined distance. Consequently, even if the two tones are localized in adjacent regions at near positions incidentally, these near positions are separated from each other at least by the predetermined distance, thereby providing a distinct pan effect. It should be noted that, if the first and second harmony voice signals are localized at left and right regions while avoiding the central space as shown in range (2), the lead voice signal is localized at the center space in a fixed manner, and a pan effect is imparted to the first and second harmony voice signals. The first and second harmony voice signals become conspicuous relative to the lead voice signal.

In one example, the localized position of the first harmony voice signal is set in a random fashion. Then, the localized position of the second harmony voice signal is set in a random fashion. At this time, the second harmony voice signal may be set in a random manner under a condition that the second harmony voice signal is localized at a position separated away from the localized position of the first harmony voice signal by more than a certain distance. In such a case, the above-mentioned regions may not be spaced; the span of the second region be determined after determining the first localized position. For example, let the localized positions of the first and second harmony voice signals be in the two regions 0 to 63 and 64 to 127. Then, if the localized position of the first harmony voice signal is determined at 60, the region in which the second harmony voice signal is to be localized is 74 to 127, 14 away from 60. Within this region 74 to 127, the localized position is selected in a random fashion.

In the foregoing, the random pan effect is imparted to the first and second harmony voice signals. It will be apparent that there is substantially no limitation to the number of tones and voices to be localized. The number of regions or partitions within the whole range may be provided more than the number of tones and voices to be localized.

Figure 7:
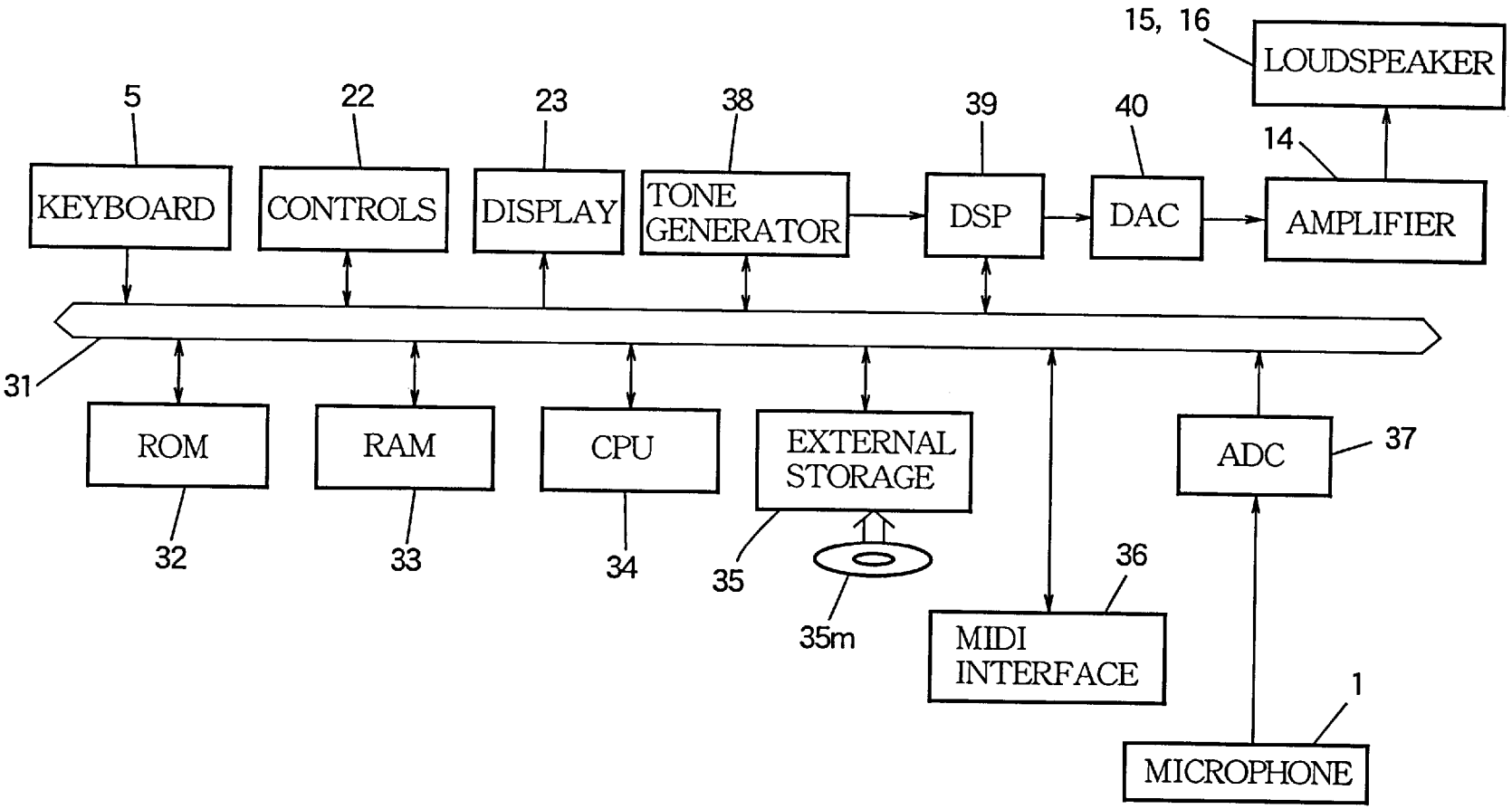
FIG. 7 is a block diagram illustrating a hardware constitution of the preferred embodiment shown in FIG. 1.

FIG. 7 shows a hardware constitution of the preferred embodiment of the audio signal processing apparatus associated with the present invention. With reference to FIG. 7, components similar to those previously described with reference to FIG. 1 are denoted by the same reference numerals and of which description will be omitted from the following. Reference numeral 31 denotes a CPU bus, reference numeral 32 denotes a ROM, reference numeral 33 denotes a RAM, reference numeral 34 denotes a CPU, reference numeral 35 denotes an external storage device, reference numeral 36 denotes a MIDI interface, reference numeral 37 denotes an ADC (A/D Converter), reference numeral 38 denotes a tone generator, reference numeral 39 denotes a DSP (Digital Signal Processor), and reference numeral 40 denotes a DAC (D/A Converter).

The CPU bus 31 is connected to plural hardware components such as the CPU 34. The group of controls 22 includes performance controls such as a pitch bend wheel and a modulation wheel and setting controls for setting tone parameters such as timbres. The display 23 displays the operation states of these controls. The ROM 32 stores an audio signal processing program according to the invention to be executed by the CPU 34 in addition to preset timbre data and a translation table for example. The RAM 33 provides a work area for the CPU 34 and a timbre editing buffer for example.

The external storage device 35 is an FDD (Floppy Disk Drive), an HDD (Hard Disk Drive), and so on. The external storage device 35 stores timbre data and song data for example, and may receive a machine readable medium 35*m* such as a floppy disk storing the audio signal processing program according to the invention, which is loaded into the RAM 33 for execution by the CPU 34. The MIDI interface 36 transfers MIDI data between the processing apparatus and an externally attached sequencer or personal computer for example.

The ADC 37 converts an input voice signal inputted from the microphone 1 into a digital signal, and outputs the same to the CPU bus 31. The tone generator 38, which does not necessarily match the function block of the tone generator 8 shown in FIG. 1, generates a tone signal from a tone parameter received from the CPU bus 31, and outputs the generated tone signal to the DSP 39. A computer program of the CPU 34 may realize the capability of the tone generator 38. The DSP 39 executes digital signal processing under the control of the CPU 34. To be more specific, the DSP 39 detects the pitch of the input voice signal, converts the detected pitch, and imparts an effect to the pitch-converted harmony voice signal and a music tone signal outputted from the tone generator 38. It should be noted that the DSP 39 may be functionally divided into blocks. To be more specific, a first DSP block detects the pitch of an input voice signal and converts the detected pitch, and a second DSP block creates an effect. The output of the ADC 37 is inputted in the first DSP block. The output of the tone generator 38 and the output of the first DSP block are inputted in the second DSP block. The DAC 40 converts an output signal of the DSP 39 into an analog signal, which is then outputted to the loudspeakers 15 and 16 through the amplifier 14.

The CPU 34 processes, by use of the RAM 33, an input voice signal from the microphone 1, operation information from the keyboard 5 and the group of controls 22, and performance information inputted through the MIDI interface 36. The CPU 34 displays various setting parameters onto the display 23, controls the tone generator 38 based on the processed performance information, and outputs MIDI data through the MIDI interface 36. The DAC 40, connected to the CPU bus 31, may execute mixing process under the control of the CPU 34. It should be noted that the embodiment may be arranged so that a lead voice signal, a harmony voice signal, a tone signal, and other audio signals obtained by mixing these tone and voice signals are stored in the external storage device 35.

Figure 8:
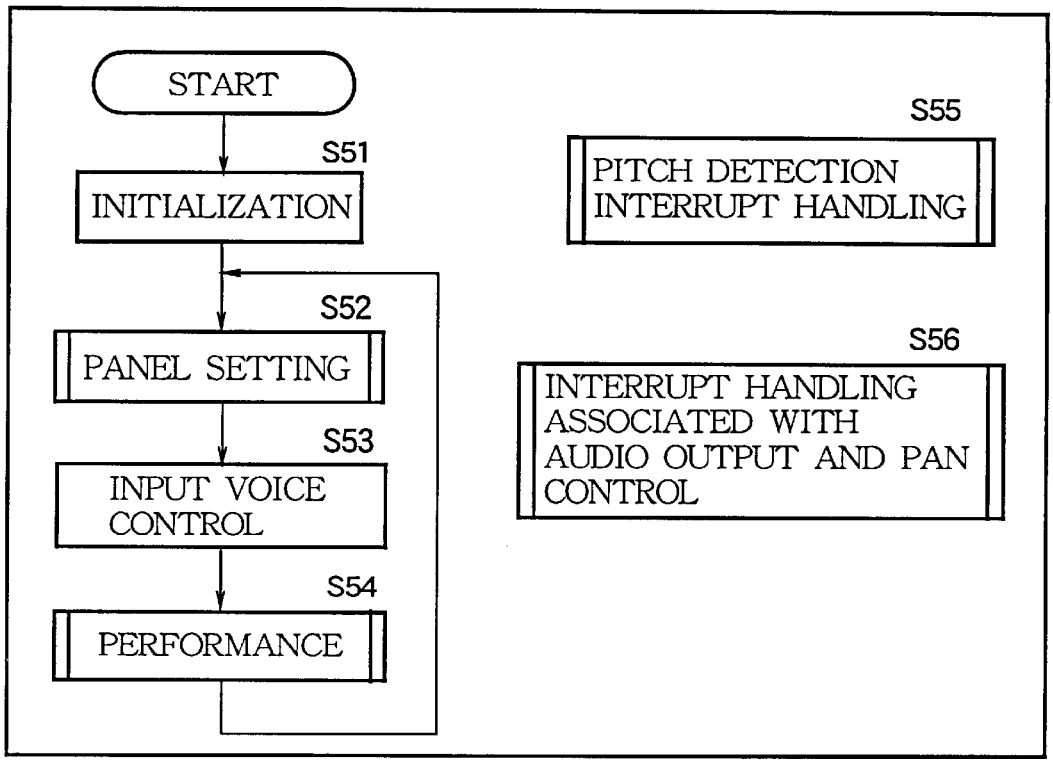
FIG. 8 shows a main flowchart indicative of operations of the preferred embodiment shown in FIG. 1 and a flowchart indicative of interrupt handlings.

FIGS. 8 through 16 are flowcharts for describing the operations of the preferred embodiment of the audio signal processing apparatus associated with the invention. To be more specific, FIG. 8 shows a main flowchart and an additional flowchart indicative of interrupt handlings. In step S51, the inventive apparatus is initialized. In step S52, a tone parameter and other information are set by use of the group of controls 22 on the operator panel 11. In step S53, a control operation such as imparting an effect to an input voice signal is executed. Description of the control operation on the input voice itself is skipped. In step S54, a harmony voice and other tones are created based on the settings made in step S52. When the processing of step S54 comes to an end, the processing operations of steps S52 through S54 are executed again. In this repetitive loop, pitch detection interrupts handling of step S55 and interrupts handling of step S56 associated with voice and tone output and pan effect application are executed.

Figure 9:
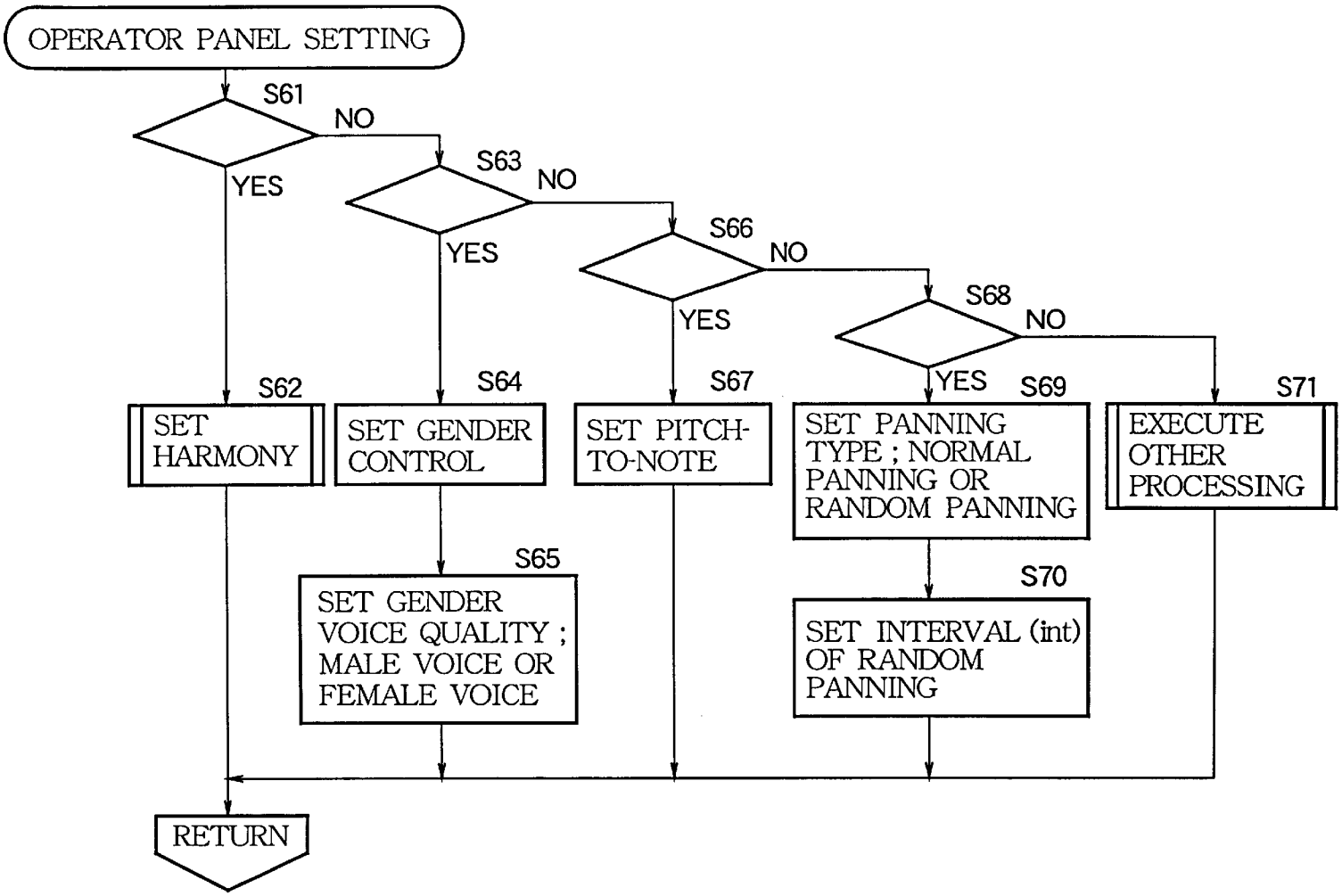
FIG. 9 shows a flowchart associated with operator panel setting operations.

FIG. 9 is a flowchart associated with the operator panel setting. In step S61, the CPU 34 determines whether the harmony mode is selected or not. If yes, the control is passed to step S62, in which harmony-associated setting is made. If not, the control is passed to step S63. Then, the CPU 34 determines whether modes of gender control, pitch-to-note, and pan setting are selected in steps S63, S66, and S68, respectively. Then, the control is passed according to each decision.

In step S64, the gender control is set as an effect to be imparted to a lead voice, which is an original input voice. In step S65, a gender voice quality, namely a male voice or a female voice is set. It should be noted that, as for a harmony voice, a male voice or a female voice is automatically set depending on the pitch difference in the description made with reference to FIG. 1. However, it is possible for the harmony voice to set gender control from the operator panel 11 likewise the lead voice. In step S69, a type of panning, namely normal panning or random panning is set. In step S70, a timing interval for shifting sound image localization in random panning is set as a specified interval (int). It should be noted that, although not shown, setting for shifting sound image localization in a random fashion for each key-on or note-on event is also executed here.

Figure 10:
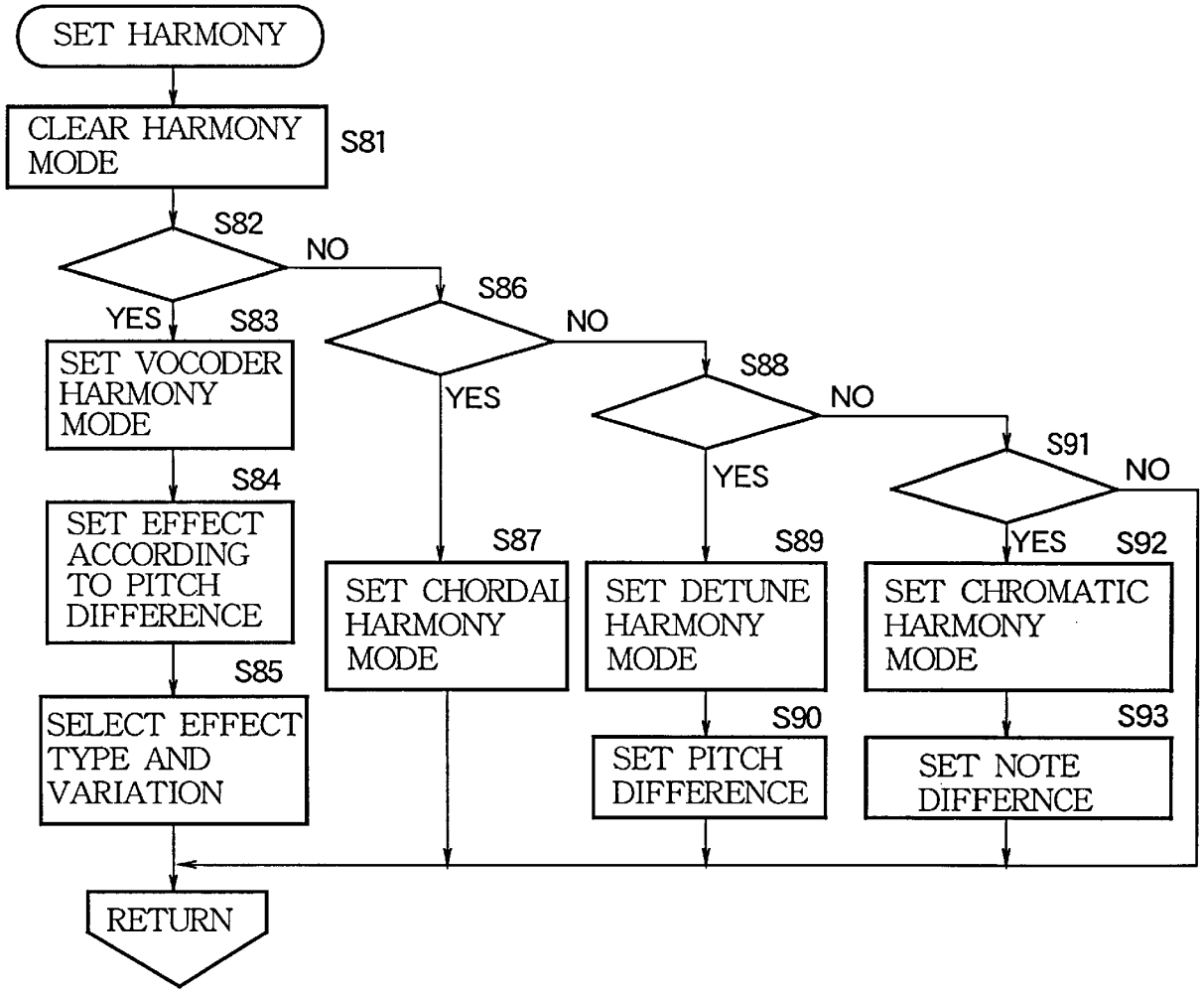
FIG. 10 shows a flowchart indicative of a "Harmony setting" step S62 of FIG. 9.

FIG. 10 is a flowchart indicative of "SET HARMONY" step S62 shown in FIG. 9. In step S81, the harmony mode is cleared. In step S82, the CPU 34 determines whether the vocoder harmony mode is selected or not. If yes, the control is passed to step S83. If not, the control is passed to step S86. Subsequently, the CPU 34 determines whether chordal harmony, detune harmony, and chromatic harmony are selected in steps S86, S88, and S91, respectively. The control is passed according to each decision.

In step S83, the vocoder harmony mode is set. In step S84, an effect is set according to a pitch difference as required. To be more specific, setting is made in which an effect to be imparted to the harmony voice signal is varied according to the difference between the vocal pitch and the harmony pitch described with reference to FIG. 3. If no effect is set dependent of the pitch difference, the control is returned without doing anything. In step S85, the type of the effect set in step S84, namely gender control, vibrato, reverberation, or tremolo for example is set. The effect change ratio can be set by use of a lookup table for example. In step S90, a detune amount is set by pitch difference. In step S93, a shift amount is set by note difference.

Figure 11:
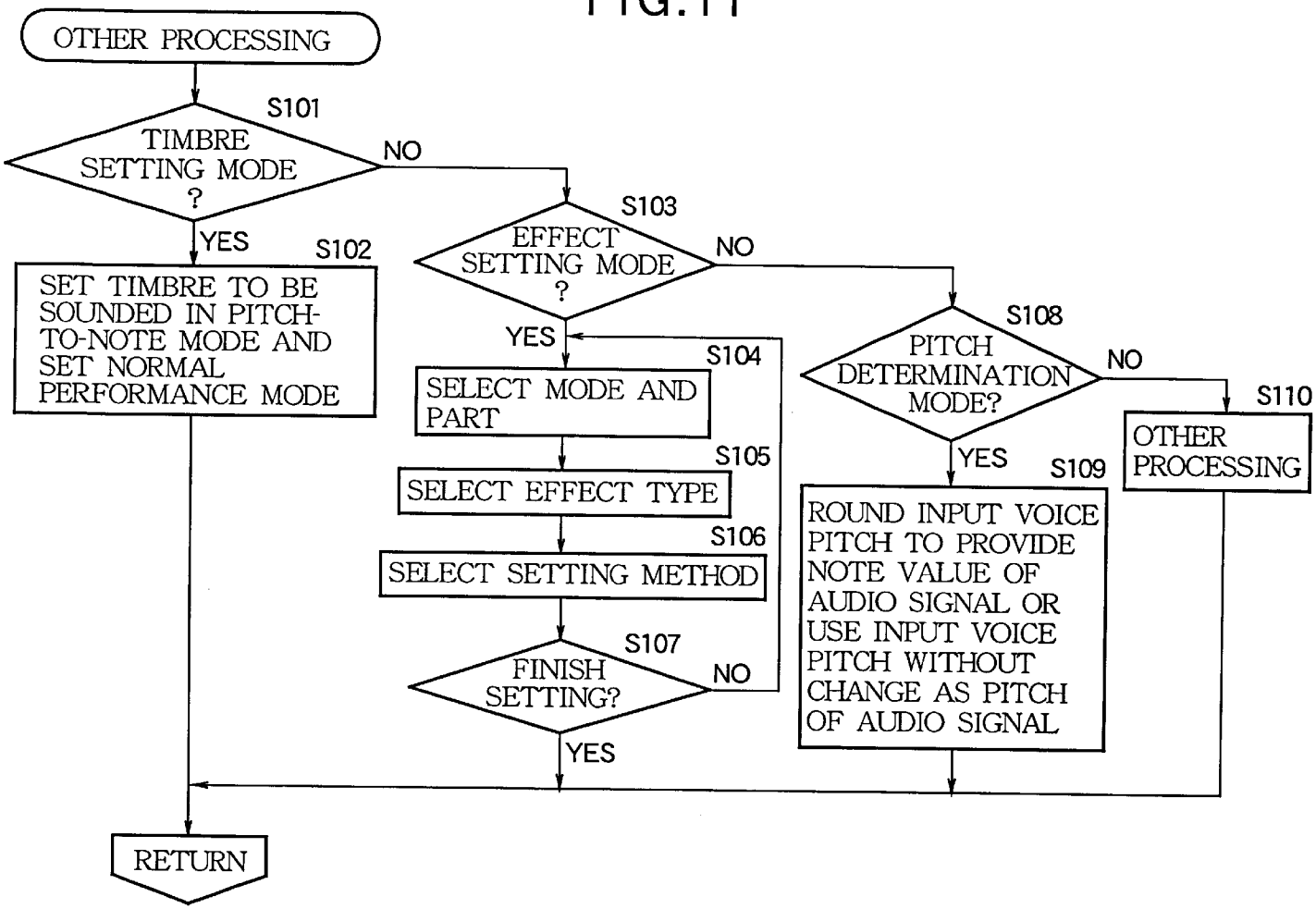
FIG. 11 shows a flowchart indicative of "Other processing operations" step S71 of FIG. 9.

FIG. 11 is a flowchart indicative of "EXECUTE OTHER PROCESSING" step S71 shown in FIG. 9. In step S101, the CPU 34 determines whether the setting mode is the timbre setting mode or not. If yes, the control is passed to step S102. If not, the control is passed to step S103. In step S102, a timbre to be used in the pitch-to-note mode is determined and the electronic musical instrument's normal performance mode is set. In step S103, the CPU 34 determines whether the setting mode is the effect setting mode or not. If yes, the control is passed to step S104. If not, the control is passed to step S108.

In steps S104 through S107, plural types of effects are set for each "sound part" or channel determined according to modes, and effect imparting timings are set. In step S104, a mode and so on are selected and a sound part to which an effect is imparted is selected. Then, the control is passed to step S105. To be more specific, the harmony mode is selected, and the lead voice part, or one or more of the harmony voice part is selected. If gender control is executed, the input voice part, or one or more of the harmony voice part to be gender-controlled is selected. In the pitch-to-note mode, a tone part of which pitch is specified by an input voice part is selected. In the normal performance mode, a music tone part to be specified by the keyboard is selected.

In step S105, an effect type is selected. Then, the control is passed to step S106. To be more specific, an effect type such as gender control, vibrato, tremolo, delay, or reverberation and an effect degree (or depth) are set to the processing channel of the part selected in step S104. In step S106, a setting method is selected. Then, the control is passed to step S107. To be more specific, in step S106, it is selected whether the effect is always imparted to the processing channel of the part selected in step S104, or the effect is imparted when a predetermined condition is satisfied according to a situation. In one example of the latter case, the effect is imparted with a delay of a preset effect application start time (utime). To be specific, this effect includes a delay effect such as delay vibrato.

In the latter case, an effect change table indicative of presence or absence of time-varied effects or the degrees and so on of time-varied effects is provided as a lookup table. This table is selected and parameters such as the above-mentioned effect application start time (utime) is inputted for computation in the effect application. To execute these selecting and inputting operations with the operator controls 22, the display 23 is switched to a data input screen. In step S107, the CPU 34 determines whether the setting operation is to be terminated by the operation of the operator controls 22. To terminate the setting operation, the control is returned. If the setting operation is not to be ended, the control is passed back to step S104. Plural types of effects may be imparted to one part of the music. In such a case, the control is passed back to step S104, in which another effect is imparted to the same part.

In step S108, the CPU 34 determines whether the mode is the pitch determination mode. If yes, the control is passed to step S109. If not, the control is passed to step S110, other processing. The processing of step S109 is conducted to execute the pitch-to-note conversion described with reference to FIGS. 1 and 4. To be more specific, in step S109, selection is made between the first processing mode in which the input voice pitch is rounded or quantized to provide a note value indicative of the pitch of a tone signal, and the second processing mode in which the input voice pitch is used without change as the pitch of the tone signal. It should be noted that, as a capability of the effect imparting module 2 for the input voice, the pitch of the input voice may be corrected in matching with a pitch for the pitch name of music, thereby generating a corrected lead voice. The processing of step S109 may be changed to set this capability.

Figure 12:
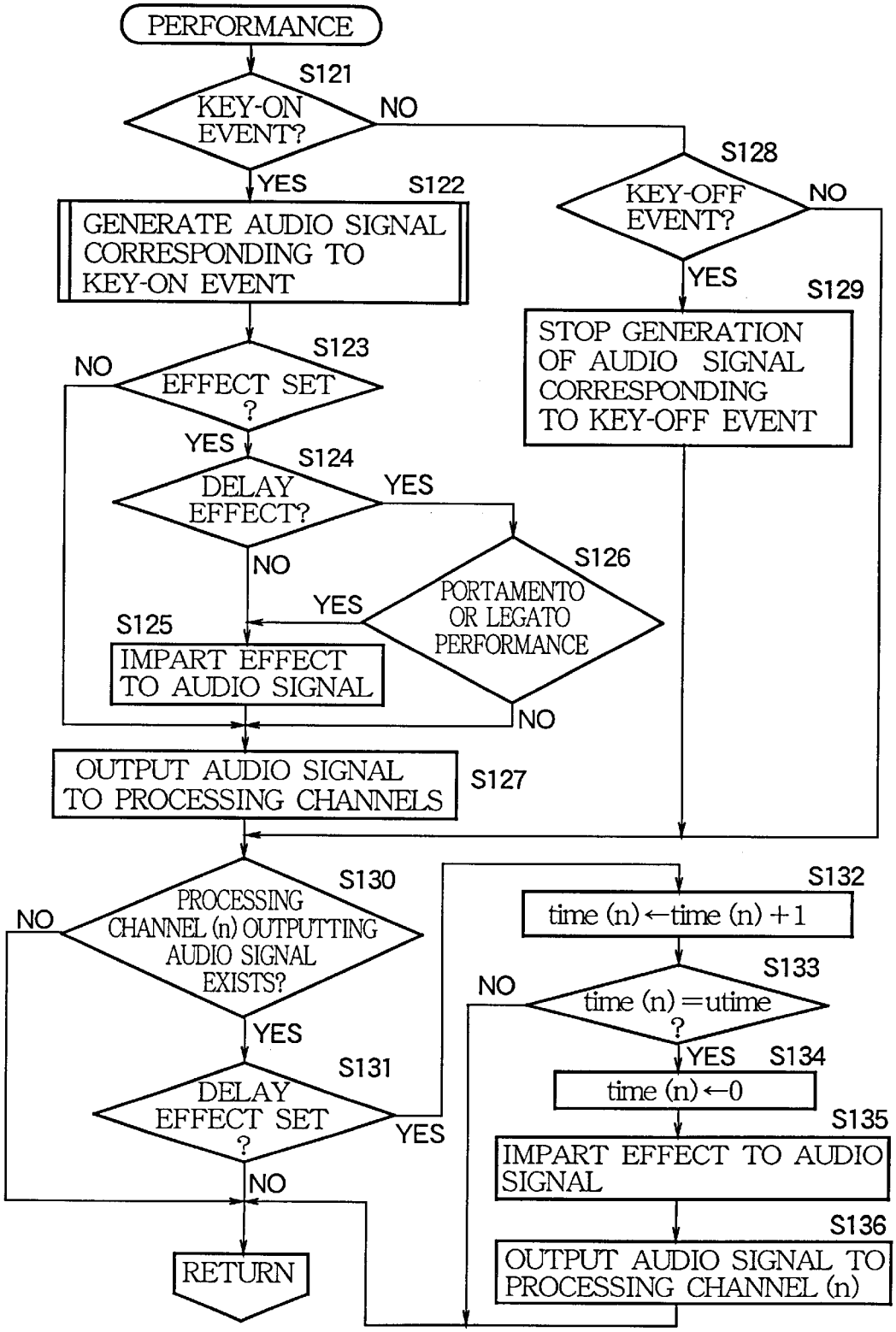
FIG. 12 shows a flowchart indicative of "Performance" step S54 of FIG. 8.
Figure 13:
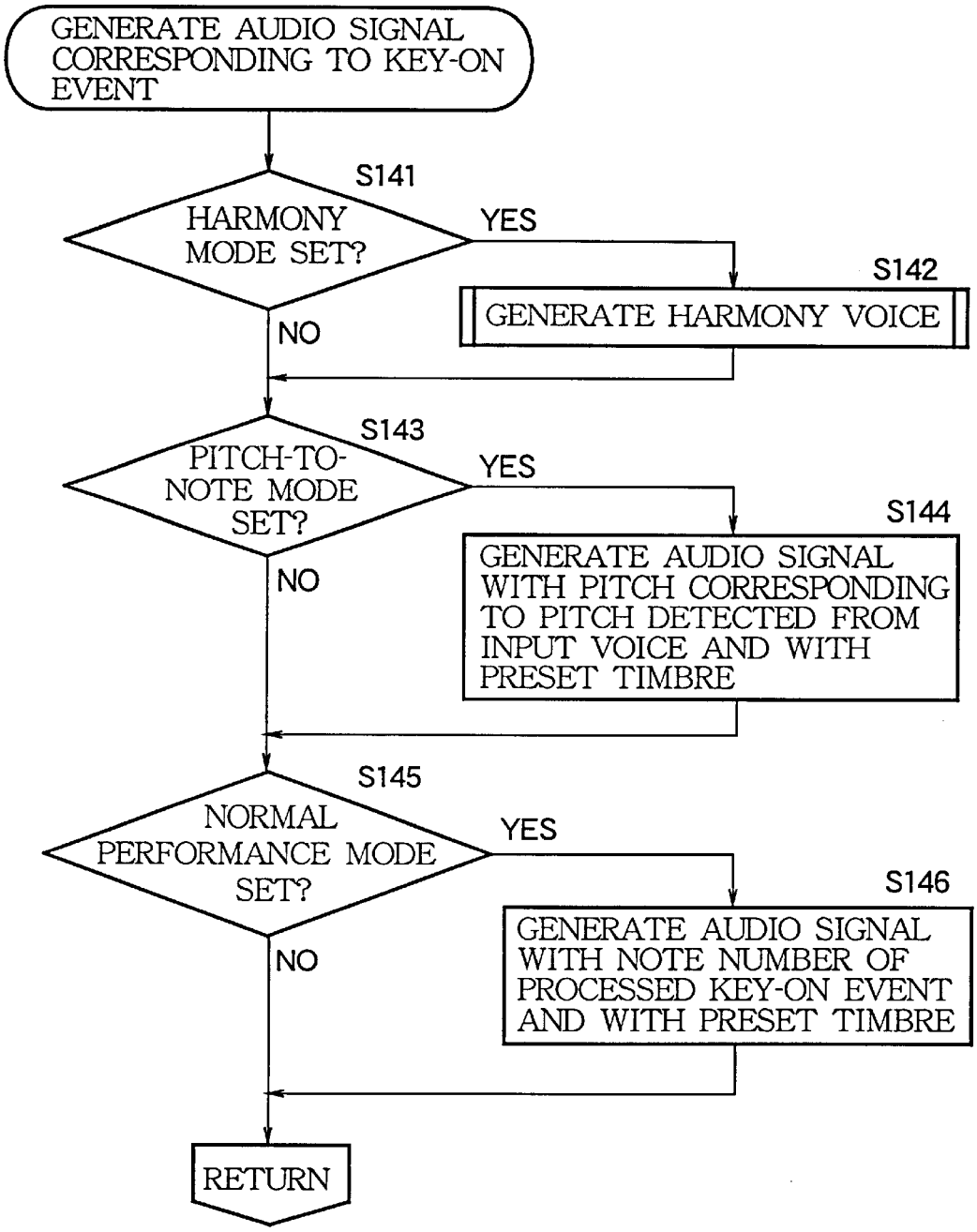
FIG. 13 shows a flowchart indicative of "Generate an audio signal corresponding to key-on event" step S122 of FIG. 12.

FIG. 12 shows a flowchart indicative of "PERFORMANCE" step S54 shown in FIG. 8. FIG. 13 shows a flowchart indicative of "GENERATE AUDIO SIGNALS FOR KEY-ON EVENT" step S122 shown in FIG. 12. In step S121 of FIG. 12, the CPU 34 determines whether a key-on event has occurred or not. If yes, the control is passed to step S122. If not, the control is passed to step S128. It should be noted that the occurrence of a note-on event in the pitch-to-note mode is processed as a key-on event and the occurrence of a note-off event is processed as a key-off event. In step S122, a voice signal and a tone signal corresponding to the key-on event are generated. The processing in step S122 will be described first with reference to FIG. 13.

In step S141 shown in FIG. 13, the CPU 34 determines whether the harmony mode is set or not. If yes, the control is passed to step S142. If not, the control is passed to step S143. In step S142, a harmony voice is generated. Then, the control is passed to step S143. The processing of S142 will be described later with reference to FIG. 14. In step S143, the CPU 34 determines whether the pitch-to-note mode is set or not. If yes, the control is passed to step S144. If not, the control is passed to step 145. In step S145, the CPU 34 determines whether the normal performance mode is set or not. If yes, the control is passed to step S146. If not, the control is returned. In step S146, a tone signal is generated with a preset timbre by the note number of the processed key-on event, upon which the control is returned.

Referring back to FIG. 12, the processing of "PERFORMANCE" step will be described. In step S123, the CPU 34 determines whether an effect is set or not. If yes, the control is passed to step S124. If not, the control is passed to step S127. It should be noted that the effect here denotes the effect that is set in steps S103 to S107. In step S124, the CPU 34 determines whether the delay effect is set or not. If yes, the control is passed to step S126. If not, the control is passed to step S125. In step S126, the CPU 34 determines whether the performance form in the pitch-to-note mode and the normal performance mode is a portamento-controlled performance form or a legato controlled performance form. If the performance form is found one of these, the control is passed to step S125. If not, the control is passed to step S127. In other words, if the delay effect is set, the same is not immediately imparted to the voice and tone signals generated in response to the key-on event (or note-on event). Subsequently, in the portamento-controlled or legato-controlled performance form, the effect imparted to the tone corresponding to the first note is sustained. In step S127, the generated voice and tone signals are outputted to the processing channel, upon which the control is passed to step S130.

On the other hand, in step S128, the CPU 34 determines whether a keyoff event has occurred or not. If yes, the control is passed to step S129. If not, the control is passed to step S130. In step S129, the generation of the voice and tone signals corresponding to the key-off event is stopped, upon which the control is passed to step S130. In step S130, the CPU 34 determines whether there is a processing channel (n) through which the voice and tone signals are outputted. If yes, the control is passed to step S131. If not, the control is returned. It should be noted that, although not shown in this figure, processing steps are executed for all active channels for voice and tone signals except the channel processing the lead voice part in steps S131 to S136. In step S131, the CPU 34 determines whether the delay effect is set or not. If yes, the control is passed to step S132. If not, the control is returned.

In step S132, time (n) is incremented by one for every channel (n) and the control is passed to step S133. In step S133, the CPU 34 determines whether the time (n) has reached the effect application start time (utime) set in step S106 of FIG. 11. If yes, the control is passed to step S134. If not, the control is returned. In step S134, the time (n) until the effect application is initialized to zero again, upon which the control is passed to step S135. In step S135, the delay effect is imparted to the voice and tone signals. In step S136, the voice and tone signals imparted with the delay effect are outputted to corresponding processing channels (n).

Figure 14:
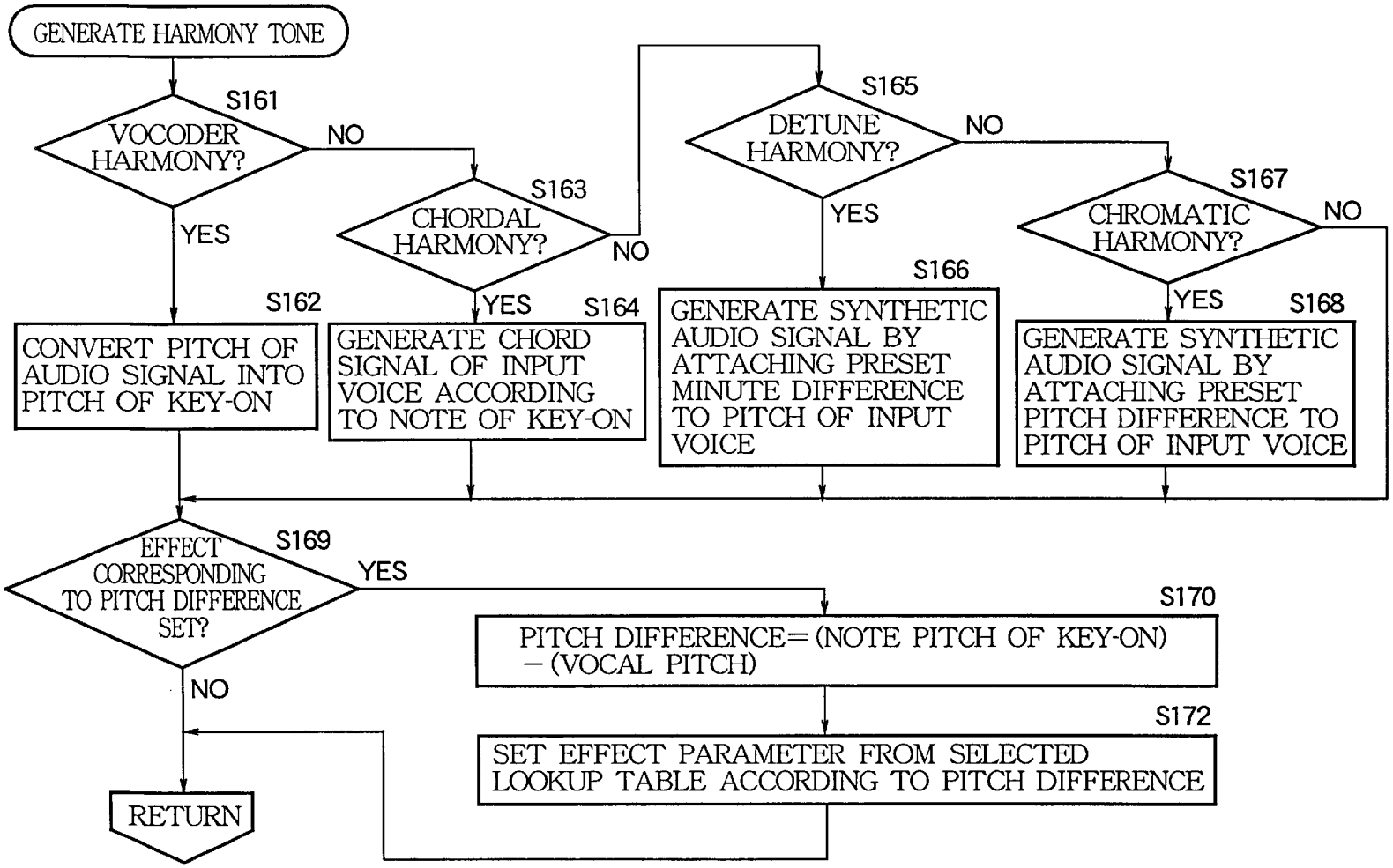
FIG. 14 shows a flowchart indicative of "Generate a harmony tone" step S142 of FIG. 13.

FIG. 14 shows a flowchart indicative of "GENERATE HARMONY VOICE" step S142 of FIG. 13. In step S161, the CPU 34 determines whether the vocoder harmony mode is set or not. If yes, the control is passed to step S162. If not, the control is passed to step S163. In step S163, the CPU 34 determines whether the chordal harmony mode is set or not. If yes, the control is passed to step S164. If not, the control is passed to step S165. In step S165, the CPU 34 determines whether the detune harmony mode is set or not. If yes, the control is passed to step S166. If not, the control is passed to step S167. In step S167, the CPU 34 determines whether the chromatic harmony mode is set or not. If yes, the control is passed to step S168. If not, the control is passed to step S169. The processing to be executed in each harmony mode is as described with reference to FIGS. 1 and 2.

In step S169, the CPU 34 determines whether the effect corresponding to pitch difference is set or not. If yes, the control is passed to step S170. If not, the control is returned. In step S170, the pitch difference is obtained by subtracting the vocal pitch from the key-on note pitch. In step S172, an effect parameter is set from a selected lookup table according to the pitch difference, upon which the control is returned.

Figure 15:
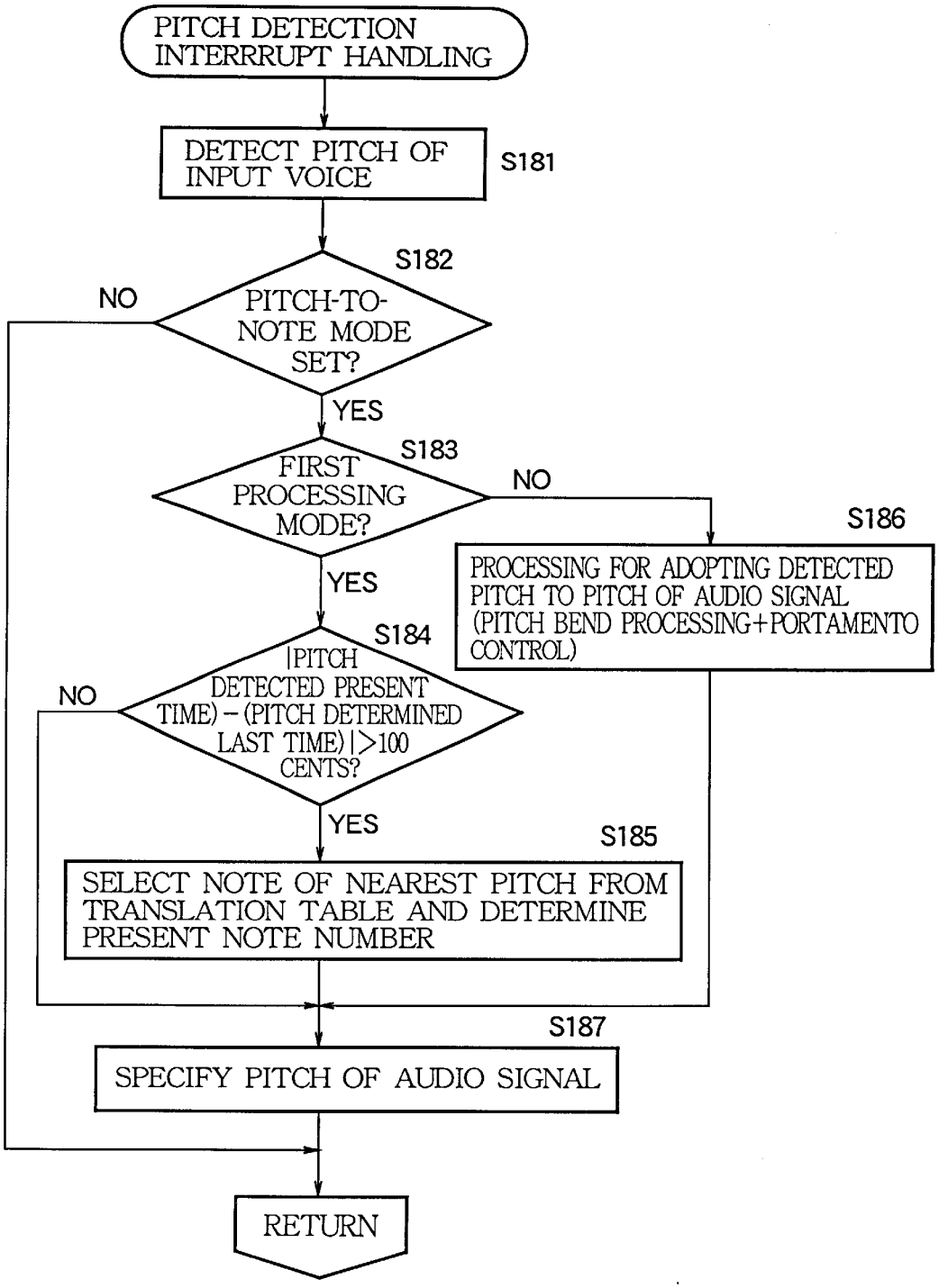
FIG. 15 shows a flowchart indicative of "Interrupt handling for pitch detection"

FIG. 15 shows a flowchart indicative of "PITCH DETECTION INTERRUPT HANDLING." This handling is started by a timer interrupt. In step S181, the pitch of an input voice is detected, upon which the control is passed to step S182. In step S182, the CPU 34 determines whether the pitch-to-note mode is set or not. If yes, the control is passed to step S183. If not, the control is returned. In step S183, the CPU 34 determines whether the first processing mode described with reference to FIG. 4A is set or not. If yes, the control is passed to step S184. If the second processing mode described with reference to FIG. 4B is found, the control is passed to step S186.

In step S184, the CPU 34 determines whether the difference between the pitch detected this time and the pitch determined last time corresponding to the note number determined by the pitch detected last time is in excess of ±100 cents (semitone) or not. If yes, the control is passed to step S185. If not, the control is passed to step S187. It should be noted that, if the pitch is detected for the first time, the control is also passed to step S185. In step S185, a pitch nearest to the pitch detected this time is selected from pitches in semitones corresponding to plural pitch names in the translation table (or lookup table) to determine the note number of this pitch name. Also, the note number corresponding to this pitch name becomes the last-time-determined pitch in the next interrupt handling.

On the other hand, in step S186, the detected pitch itself is processed to provide the pitch of the tone, upon which the control is passed to step S187. To be more specific, as described with reference to FIG. 4B, this processing is executed by combination of the pitch bend processing and the portamento control. In step S187, the pitch of the tone is specified by the note number detected in step S185 or the pitch bend data specified in step S186 and the note number of the center pitch. Then, the control is returned.

Figure 16:
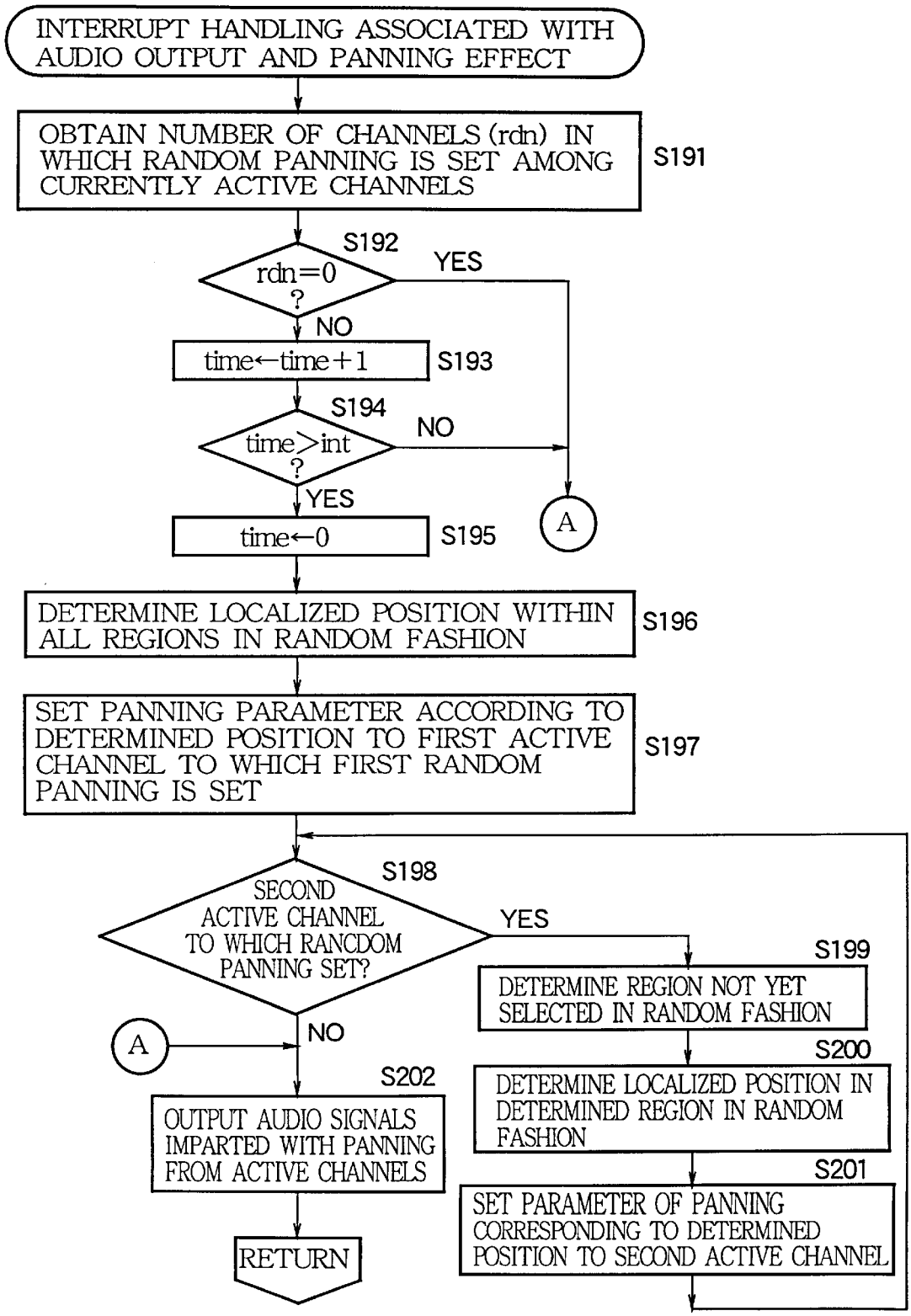
FIG. 16 shows a flowchart indicative of "Interrupt handling associated with audio output and panning effect."

FIG. 16 shows a flowchart indicative of "INTERRUPT HANDLING ASSOCIATED WITH AUDIO OUTPUT AND PAN EFFECT." This processing is started by a timer interrupt. In step S191, the number of processing channels (rdn) to which random panning is set is obtained among currently sounding channels. It should be noted that this interrupt handling involves a processing channel of the lead voice part. In step S192, the CPU 34 determines if rdn=0. If yes, the control is passed to step S202. If not, the control is passed to step S193, in which the time is incremented by one. In step S194, the CPU 34 determines whether the time is in excess of the specified length (int) of random panning. If yes, the control is passed to step S195. If not, the control is passed to step S202. In step S195, the time is initialized again.

The processing operations in steps S196 through S202 are particular examples of the random panning effect described with reference to FIG. 6. In step S196, the localized position of the voice or tone is determined in a random fashion in one of all regions or partitions. In step S197, the value of panning parameter is set according to the determined random position to the sounding channel in which the first random panning is set. In step S198, the CPU 34 searches for another processing channel to which random panning is set.

If such a processing channel is found, the control is passed to step S199. If not, the control is passed to step S202. In step S202, for the processing channel to which no random panning is set, a localized position is determined at the center point, for example.

In step S199, a region not yet selected is determined in a random fashion. In step S200, a localized position is determined in a random fashion within the determined region. In step S201, the value of panning parameter is set based on the position determined in step S200 to the processing channel which is found by the search of step S198. Then, the control is returned. In step S202, each processing channel outputs the voice and tone signals imparted with panning, upon which the control returns.

In the foregoing, the harmony voice and other tones are generated based on the user's voice inputted from the microphone 1. It will be apparent that the original audio signal from which these tones are generated is not limited to a human voice. Any sound, such as an animal voice, may be used as far as its pitch is detectable. An audio signal to which a panning effect is imparted may be a tone signal of which pitch cannot be detected such as a noise signal. A sound of which pitch cannot be detected is occasionally used as a timbre of an electronic musical instrument.

The present invention is suitable for use in processing a singing voice in real time. The present invention can also reproduce a recorded user's voice and capture the same for processing. In addition, the pitch specification for controlling the pitch of a harmony voice can be executed by use of MIDI data stored in a music data file, instead of using the keyboard 5.

In the foregoing, a signal in which a user's voice is not pitch-converted is used as a lead voice signal, which is mixed with a harmony voice signal, the resultant signal being outputted from the loudspeakers 15 and 16. It will be apparent that the inventive apparatus may sound only a harmony voice signal. It will also be apparent that the user's voice itself can be sounded through another audio amplifier.

It will be apparent that the inventive apparatus may be applied to a karaoke machine and an automatic music playing machine. The inventive signal processor apparatus may treat not only live music information inputted from a music keyboard or microphone but also recorded music information reproduced from a record medium.

The machine readable medium 35*m* is used in a computer machine (FIG. 7) having the CPU 34 for generating an auxiliary audio signal such as the harmony voice signal based on an original audio signal such as the input voice signal and for mixing the auxiliary audio signal to the original audio signal. The medium 35*m* contains program instructions executable by the CPU 34 for causing the computer machine to perform the method comprising the steps of designating a pitch of the auxiliary audio signal, processing the original audio signal to generate the auxiliary audio signal having the designated pitch, applying a first effect to the generated auxiliary audio signal, applying a second effect different from the first effect to the original audio signal, and outputting the original audio signal applied with the second effect concurrently with the auxiliary audio signal applied with the first effect. Further, the machine readable medium 35*m* may contain program instructions executable by the CPU 34 for causing the computer machine to perform the method comprising the steps of detecting an original pitch of the original audio signal, carrying out a pitch conversion of the original audio signal based on the detected original pitch to generate the auxiliary audio signal having a converted pitch, applying an effect to the generated auxiliary audio signal, and altering the effect applied to the auxiliary audio signal dependently on a difference between the original pitch of the original audio signal and the converted pitch of the auxiliary audio signal.

The machine readable medium 35*m* may be used in the computer machine having the CPU 34*m* and generating a synthetic audio signal such as the music tone signal in response to an original audio signal such as the input voice signal. The medium 35*m* contains program instructions executable by the CPU 34 for causing the computer machine to perform the method comprising the steps of sequentially detecting a pitch of the original audio signal, operating the tone generator 8 to generate the synthetic audio signal having a pitch varying in response to that of the original audio signal, operating the controller 6 in a first mode for quantizing the detected pitch of the original audio signal into a sequence of notes to control the generator 8 such that the pitch of the synthetic audio signal varies stepwise in matching with the sequence of the notes, operating the controller 6 in a second mode for controlling the generator 8 according to the detected pitch of the original audio signal such that the pitch of the synthetic audio signal continuously varies to follow that of the original audio signal, and switching the controller 6 between the first mode and the second mode.

The machine readable medium 35*m* nay contain program instructions executable by the CPU 34 for causing the computer machine to perform the method comprising the steps of detecting a pitch of the original audio signal, detecting a volume of the original audio signal, operating the tone generator 8 to generate the synthetic audio signal, controlling the generator 8 to vary a pitch of the synthetic audio signal according to the detected pitch of the original audio signal, and controlling the generator 8 to vary a volume of the synthetic audio signal according to the detected volume of the original audio signal.

The machine readable medium 35*m* may contain program instructions executable by the CPU 34 for causing the computer machine to perform the method comprising the steps of detecting a varying pitch of the original audio signal, operating the tone generator 8 to generate the synthetic audio signal, and controlling the generator 8 to vary a pitch of the synthetic audio signal according to the detected varying pitch of the original audio signal. The step of controlling comprises determining a first note from the detected varying pitch of the original audio signal for controlling the generator 8 to generate the first note of the synthetic audio signal while bending a pitch of the synthetic audio signal around the first note in response to a deviation of the detected varying pitch from the first note, and then determining a second note from the detected varying pitch when the deviation thereof from the first note exceeds a predetermined value for controlling the generator 8 to stop the first note and to generate the second note of the synthetic audio signal.

The machine readable medium 35*m* may contain program instructions executable by the CPU 34 for causing the computer machine to perform the method comprising the steps of operating the generator 8 to generate the audio signal for creating either of a continuous sequence of music notes and a discrete sequence of music notes, triggering the effector 9 in response to an occurrence of each music note for applying a time-varying effect to each music note of the generated audio signal, and detecting when the generator 8 generates the continuous sequence of the music notes including a first music note and subsequent music notes, and controlling the effector 9 to maintain the time-varying effect once applied to the first music note even after the first music note ceases so that the time-varying effect is continuously applied to the subsequent music notes while preventing further time-varying effects from being triggered in response to the subsequent music notes. The machine readable medium 35*m* may contain program instructions executable by the CPU 34 for causing the computer machine to perform the method comprising the steps of providing a plurality of audio signals such as first and the second harmony voice signals concurrently with each other, mixing the plurality of the audio signals with each other while locating the plurality of the audio signals to a plurality of regions, and randomizing the locating of the audio signals among the plurality of the regions. The step of randomizing comprises randomly assigning one region to one of the audio signals, and then randomly assigning another of the remaining regions except for said one region to another of the audio signals to thereby avoid duplicate assignment of the same region to different ones of the audio signals while ensuring randomization of the locating of the audio signals.

The machine readable medium 35*m* contains program instructions executable by the CPU 34 for causing the computer machine to perform the method comprising the steps of defining a plurality of regions such that one region is separated from another region by a space, providing a plurality of audio signals concurrently with each other, mixing the plurality of the audio signals with each other while locating the plurality of the audio signals to the plurality of the regions other than the space, and randomizing the locating of the audio signals among the plurality of the regions such that different ones of the audio signals are located to different ones of the regions.

As described and according to the first aspect of the invention, an original voice and a harmony voice do not take on a similar feeling, thereby preventing the harmony voice from becoming blurred. Consequently, a wide range of performance effects are expected, and appropriate effects can be imparted intentionally under performance conditions, thereby enhancing the performance effects.

As described and according to the second aspect of the invention, the user can freely make selection between a performance in which the pitch of a tone to be generated is quantized in matching with the pitch name of the input voice signal so as to vary in stepwise, and another performance in which the pitch of a tone to be generated follows the pitch of the input voice signal so as to vary smoothly without steps. Consequently, while singing a song, the user can switch in real time basis between the two performances of the tone signal pitch variation. The user can sing a song repeatedly by changing his or her voice quality until the tone signal having a desired pitch is obtained before inputting his or her singing voice into a recording/reproducing device. In addition, controlling the intensity of a tone signal based on the intensity of an input voice signal allows realistic performance with variation and powerfulness. Consequently, the artistic sense of the user's singing can be expressed by the intensity of the synthetic tone signal.

As described and according to the third aspect of the invention, a tone signal of which pitch can continuously vary by following the continuously varying pitch of a voice signal is generated and resounding of the tone signal is made less conspicuous.

As described and according to the fourth aspect of the invention, if tone signals are continuously generated under portamento-control for example, a delay effect and so on can be imparted without causing a feeling of disagreeableness.

As described and according to the fifth aspect of the invention, the localized positions of voice signals and tone signals are not clustered at one point. Consequently, the stable random panning can be ensured.

While the invention has been shown in several forms, it is obvious to those skilled in the art that it is not so limited but is susceptible of various changes and modifications without departing from the spirit and scope of the claimed invention.

What is claimed is:

1. An audio processing apparatus for generating an auxiliary audio signal based on an original audio signal and mixing the auxiliary audio signal to the original audio signal, the apparatus comprising:

a control section that includes an input device and that designates a pitch of the auxiliary audio signal by manual operation of the input device;

a processing section that processes the original audio signal under control of the control section to generate the auxiliary audio signal having the designated pitch, and that applies a first effect to the generated auxiliary audio signal, the first effect being a gender control converting a gender of the generated auxiliary audio signal between a male voice and a female voice;

an effector section that applies a second effect different from the first effect to the original audio signal; and an output section that outputs the original audio signal applied with the second effect concurrently with the auxiliary audio signal applied with the first effect, wherein the control section controls the processing section to apply the first effect to the generated auxiliary audio signal when a difference between a pitch of the original audio signal and the designated pitch of the auxiliary audio signal exceeds a given threshold value.

2. An audio processing method of generating an auxiliary audio signal based on an original audio signal and mixing the auxiliary audio signal to the original audio signal, the method comprising the steps of:

designating a pitch of the auxiliary audio signal;

processing the original audio signal to generate the auxiliary audio signal having the designated pitch;

applying a first effect to the generated auxiliary audio signal, the first effect being a gender control converting a gender of the generated auxiliary audio signal between a male voice and a female voice, when a difference between a pitch of the original audio signal and the designated pitch of the auxiliary audio signal exceeds a given threshold value;

applying a second effect different from the first effect to the original audio signal; and outputting the original audio signal applied with the second effect concurrently with the auxiliary audio signal applied with the first effect.

3. A machine readable medium for use in a computer machine having a CPU for generating an auxiliary audio signal based on an original audio signal and mixing the auxiliary audio signal to the original audio signal, the medium containing program instructions executable by the CPU for causing the computer machine to perform the method comprising the steps of:

designating a pitch of the auxiliary audio signal;

processing the original audio signal to generate the auxiliary audio signal having the designated pitch;

applying a first effect to the generated auxiliary audio signal, the first effect being a gender control converting a gender of the generated auxiliary audio signal between a male voice and a female voice, when a difference between a pitch of the original audio signal and the designated pitch of the auxiliary audio signal exceeds a given threshold value;

applying a second effect different from the first effect to the original audio signal; and outputting the original audio signal applied with the second effect concurrently with the auxiliary audio signal applied with the first effect.

4. An audio processing apparatus for generating an auxiliary audio signal based on an original audio signal and mixing the auxiliary audio signal to the original audio signal, the apparatus comprising:

a control section that includes an input device and that designates a pitch of the auxiliary audio signal by manual operation of the input device;

a processing section that processes the original audio signal under control of the control section to generate the auxiliary audio signal having the designated pitch, and that applies a first effect to the generated auxiliary audio signal according to an effect parameter value;

an effector section that applies a second effect different from the first effect to the original audio signal; and an output section that outputs the original audio signal applied with the second effect concurrently with the auxiliary audio signal applied with the first effect, wherein the control section controls the processing section to alter a manner of applying the first effect to the generated auxiliary audio signal based on a difference between a pitch of the original audio signal and the designated pitch of the auxiliary audio signal such that the effect parameter value varies continuously in accordance with the pitch difference between the pitch of the original audio signal and the designated pitch of the auxiliary audio signal.

5. The audio apparatus according to claim 4, wherein the control section controls the processing section such that an increase ratio of the effect parameter value varies as the pitch difference increases between the pitch of the original audio signal and the designated pitch of the auxiliary audio signal.

6. An audio processing apparatus for generating an auxiliary audio signal based on an original audio signal and mixing the auxiliary audio signal to the original audio signal, the apparatus comprising:

a control section that includes an input device and that designates a pitch of the auxiliary audio signal by manual operation of the input device;

a processing section that processes the original audio signal under control of the control section to generate the auxiliary audio signal having the designated pitch, and that applies a first effect to the generated auxiliary audio signal;

an effector section that applies a second effect different from the first effect to the original audio signal; and an output section that outputs the original audio signal applied with the second effect concurrently with the auxiliary audio signal applied with the first effect, wherein the control section controls the processing section to apply one type of the first effect when a difference between a pitch of the original audio signal and the designated pitch of the auxiliary audio signal is positive, the one type of first effect continuously varying in accordance with the positive difference in pitch, and to apply another type of the first effect when a difference between a pitch of the original audio signal and the designated pitch of the auxiliary audio signal is negative, the other type of first effect also continuously varying in accordance with the negative difference in pitch.

* * * * *